US009146522B2

(12) United States Patent
Yamamizu

(10) Patent No.: US 9,146,522 B2
(45) Date of Patent: Sep. 29, 2015

(54) IMAGE FORMING APPARATUS, AND METHOD OF CONTROLLING IMAGE FORMING APPARATUS

(71) Applicant: CANON KABUSHIKI KAISHA, Tokyo (JP)

(72) Inventor: Hiroshi Yamamizu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/021,944

(22) Filed: Sep. 9, 2013

(65) Prior Publication Data

US 2014/0072323 A1 Mar. 13, 2014

(30) Foreign Application Priority Data

Sep. 11, 2012 (JP) ..... 2012-199610

(51) Int. Cl.
*G03G 15/00* (2006.01)

(52) U.S. Cl.
CPC ..... *G03G 15/80* (2013.01); *G03G 15/5004* (2013.01)

(58) Field of Classification Search
CPC ..... G03G 15/5004; G03G 15/80
USPC ..... 399/37, 88
See application file for complete search history.

(56) References Cited

U.S. PATENT DOCUMENTS

| | | | | |
|---|---|---|---|---|
| 7,543,165 | B2 * | 6/2009 | Inoue | 713/300 |
| 2007/0240159 | A1 * | 10/2007 | Sugiyama | 718/102 |
| 2008/0155286 | A1 * | 6/2008 | Hirai | 713/320 |
| 2010/0166448 | A1 * | 7/2010 | Mikami | 399/88 |
| 2010/0185833 | A1 * | 7/2010 | Saito et al. | 712/203 |
| 2011/0078465 | A1 * | 3/2011 | Ito | 713/300 |
| 2012/0303988 | A1 * | 11/2012 | Yasuda | 713/320 |
| 2012/0307285 | A1 * | 12/2012 | Naya et al. | 358/1.14 |
| 2013/0050752 | A1 * | 2/2013 | Naya et al. | 358/1.15 |
| 2013/0205153 | A1 * | 8/2013 | Yokoyama | 713/323 |

FOREIGN PATENT DOCUMENTS

JP 2011-71760 A 4/2011

* cited by examiner

*Primary Examiner* — Ryan Walsh
(74) *Attorney, Agent, or Firm* — Canon U.S.A., Inc., IP Division

(57) ABSTRACT

In a first power state of an image forming apparatus in which a first power supply unit supplies power to a network I/F but does not supply power to a central processing unit (CPU), if a received packet is a first type packet, a power supply control unit shifts the image forming apparatus to a second power state in which the first power supply unit supplies power to the CPU but the second power supply unit does not supply power to the image forming unit. If the received packet is a second type packet, the power supply control unit shifts the image forming apparatus to a third power state in which the first power supply unit supplies power to the CPU and the second power supply unit supplies power to the image forming unit.

12 Claims, 21 Drawing Sheets

IMAGE FORMING APPARATUS, AND METHOD OF CONTROLLING IMAGE FORMING APPARATUS

BACKGROUND

1. Field

Aspects of the present invention generally relate to a control executed at the time when an image forming apparatus being in a sleep state receives a packet via a network to recover the image forming apparatus.

2. Description of the Related Art

Conventionally, an image forming apparatus that performs network communication has a function to automatically shift to a sleep state to reduce power consumption when the image forming apparatus has not been used for a predetermined period or longer. While the image forming apparatus is in the sleep state, another apparatus operates the image forming apparatus via a network to recover the image forming apparatus from the sleep state.

A method for the recovery from the sleep state has been discussed in which an image forming apparatus receives an input signal from a network and recovers from the sleep state if a pattern of the received input signal matches an input signal pattern that is registered in advance.

There is also a method in which when an image forming apparatus recovers from the sleep state, whether to supply power to respective devices in the image forming apparatus is selected and then the image forming apparatus recovers from the sleep state (refer to Japanese Patent Application Laid-Open No. 2011-71760).

The following discusses a case of the foregoing conventional techniques in which an image forming apparatus being in the sleep state receives a network packet and then power is supplied to some of the devices in the image forming apparatus to recover the image forming apparatus.

In this case, a power control apparatus cannot determine whether the packet received via the network is a job packet that requires printing operation or any other packet such as an inquiry about the apparatus. Thus, power can be supplied only to some of the devices. Hence, when the image forming apparatus receives a job packet that requires power supply to every device, the image forming apparatus undergoes a state in which power is supplied to some of the devices, and thereafter power is supplied to every device. This may cause a delay in printing operation after the recovery from the sleep state.

Furthermore, the supply of power to every device at the time of recovery from the sleep state may lead to excess power consumption if the packet received via the network is a mere inquiry of the status of the apparatus.

SUMMARY

Aspects of the present invention are generally directed to enabling recovery from a sleep state in an optimum power state without unnecessary waste to reduce excess power consumption.

According to an aspect of the present invention, an image forming apparatus configured to operate in a plurality of power states includes a receiving unit configured to receive data, a control unit configured to process data received by the receiving unit; an image forming unit configured to form an image on a sheet using the data processed by the control unit, a first power supply unit configured to supply power to the control unit and the receiving unit, a second power supply unit configured to supply power to the image forming unit, and a power control unit, in a first power state in which the first power supply unit supplies power to the receiving unit but does not supply power to the control unit, to perform control such that in a case where a received packet received by the receiving unit is a first type packet, the first power supply unit supplies power to the control unit but the second power supply unit does not supply power to the image forming unit, and in a case where a received packet received by the receiving unit is a second type packet, the first power supply unit supplies power to the control unit and the second power supply unit supplies power to the image forming unit.

Further features and aspects of the present disclosure will become apparent from the following description of exemplary embodiments with reference to the attached drawings.

DESCRIPTION OF THE EMBODIMENTS

Exemplary embodiments will be described below with reference to the drawings.

The following describes a first exemplary embodiment.

Figure 1:
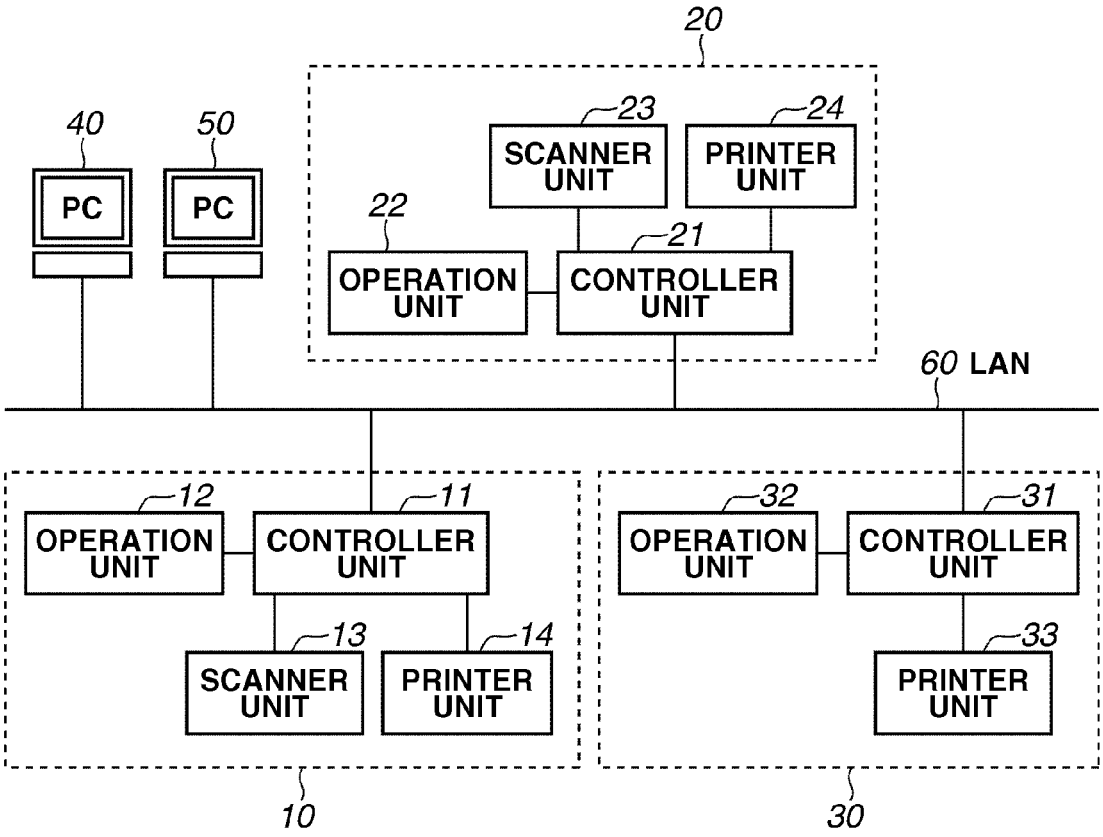
FIG. 1 is a block diagram illustrating an example of the configuration of a network system to which an image forming apparatus according to an exemplary embodiment is applicable.

FIG. 1 is a block diagram illustrating an example of the configuration of a network system to which an image forming apparatus according to the exemplary embodiment is applicable. In the example illustrated in FIG. 1, host computers 40 and 50 and image forming apparatuses 10, 20, and 30 are connected to a local area network (LAN) 60, but the number of apparatuses connected to the system according to the exemplary embodiment is not limited to that in the example illustrated in FIG. 1. Further, although the present exemplary embodiment adopts the LAN to connect apparatuses, this embodiment is not seen to be limiting to the LAN. For example, an arbitrary network such as a wide area network (WAN) (public line) is also adoptable.

The host computers (hereinafter "PCs") 40 and 50 have a function of a general personal computer. The PCs 40 and 50 are capable of transmitting and receiving files and electronic mails via the LAN 60 or a WAN using a file transfer protocol (FTP) or a server message block (SMB) protocol.

The PCs 40 and 50 are also capable of giving a printing command to the image forming apparatuses 10, 20, and 30 via a printer driver. The PCs 40 and 50 are also capable of inquiring about the status of each image forming apparatus to the image forming apparatuses 10, 20, and 30 at regular intervals, and in response to a request from the PCs 40 and 50, the image forming apparatuses 10, 20, and 30 can return information such as information about whether the image forming apparatuses 10, 20, and 30 are ready to execute printing.

The image forming apparatuses 10 and 20 have the same configuration. The image forming apparatuses 10 and 20 each include a scanner unit. The image forming apparatus 30 only has a printing function and does not include the scanner unit included in each of the image forming apparatuses 10 and 20.

To simplify description, the configuration of the image forming apparatus 10 among the image forming apparatuses 10 and 20 will be described in detail below. The image forming apparatus 20 has the same configuration as that of the image forming apparatus 10. The image forming apparatus 30 has the same configuration as that of the image forming apparatus 10 except for the scanner unit.

The image forming apparatus 10 includes a scanner unit 13, a printer unit 14, a controller (controller unit) 11, and an operation unit 12. The scanner unit 13 is an image input device. The printer unit 14 is an image output device. The controller (controller unit) 11 controls the operation of the entire image forming apparatus 10. The operation unit 12 is a user interface (UI).

Figure 2:
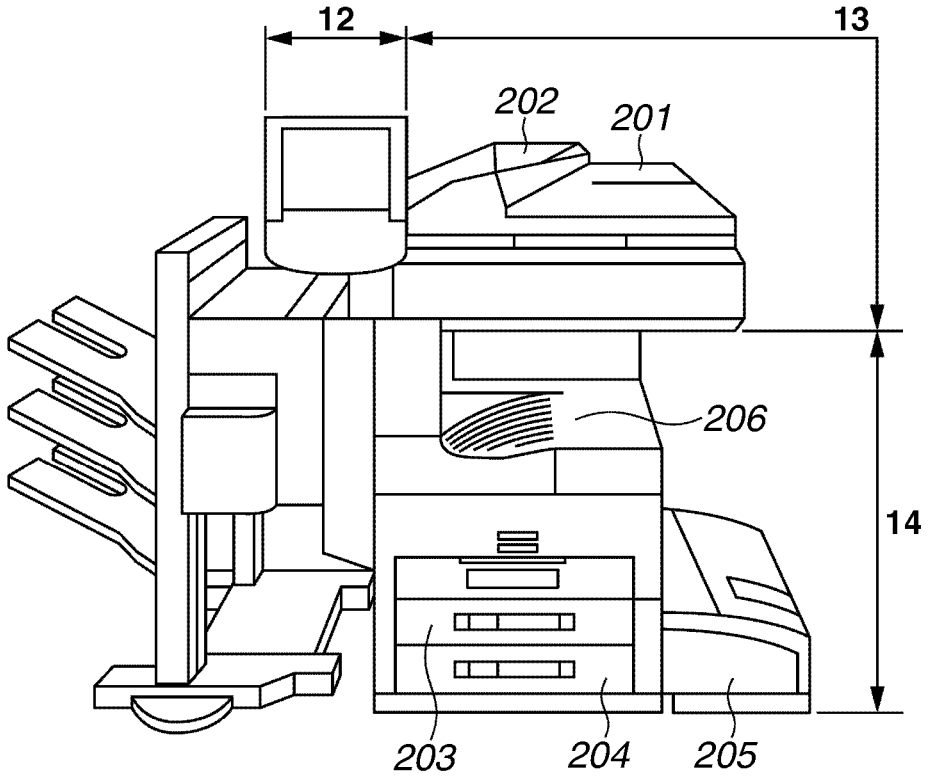
FIG. 2 is a view illustrating an example of an outer configuration of an image forming apparatus 10.

The following describes the outer configuration of the image forming apparatus 10. FIG. 2 is a view illustrating an example of the outer configuration of the image forming apparatus 10. The scanner unit 13 includes a plurality of charge coupled devices (CCD). If the CCDs have different sensitivities, even if each pixel of a document has the same density, the CCDs recognize the each pixel as having density different from each other. Thus, the scanner unit 13 first executes exposure scanning on a white board (uniformly white board) and converts the amount of reflected light obtained by the exposure scanning into electric signals to output the electric signals to the controller 11.

The following describes how an image on the document is scanned. The scanner unit 13 inputs into the CCDs the reflected light obtained by exposure scanning the image on the document, whereby information on the image is converted into electric signals. The scanner unit 13 then converts the electric signals into luminance signals of colors R, G, and B and outputs the luminance signals as image data to the controller 11.

Documents are placed on a tray 202 of a document feeder 201. When a user gives an instruction via the operation unit 12 to start reading the documents, the controller 11 gives a document reading instruction to the scanner unit 13. When the scanner unit 13 receives the document reading instruction, the scanner unit 13 feeds the documents one by one from the tray 202 of the document feeder 201 to perform a document reading operation. As to a document reading method, a method in which documents are placed on a glass plate (not illustrated) and an exposure unit moves to scan the documents may be used instead of the method in which the document feeder 201 automatically feeds the documents.

The printer unit 14 is an image forming device configured to form image data received from the controller 11 on a sheet. Although an image forming method used in the present exemplary embodiment is an electrophotographic method in which a photosensitive drum and a photosensitive belt are used, the use of an electrophotographic method is not limiting. Other printing methods, such as a sublimation method and an inkjet method in which ink is discharged from a minute nozzle array to print on a sheet, are applicable.

The printer unit 14 includes a plurality of sheet cassettes 203, 204, and 205 for enabling selection of different sheet sizes and orientations. Printed sheets are discharged to a sheet discharge tray 206.

Figure 3:
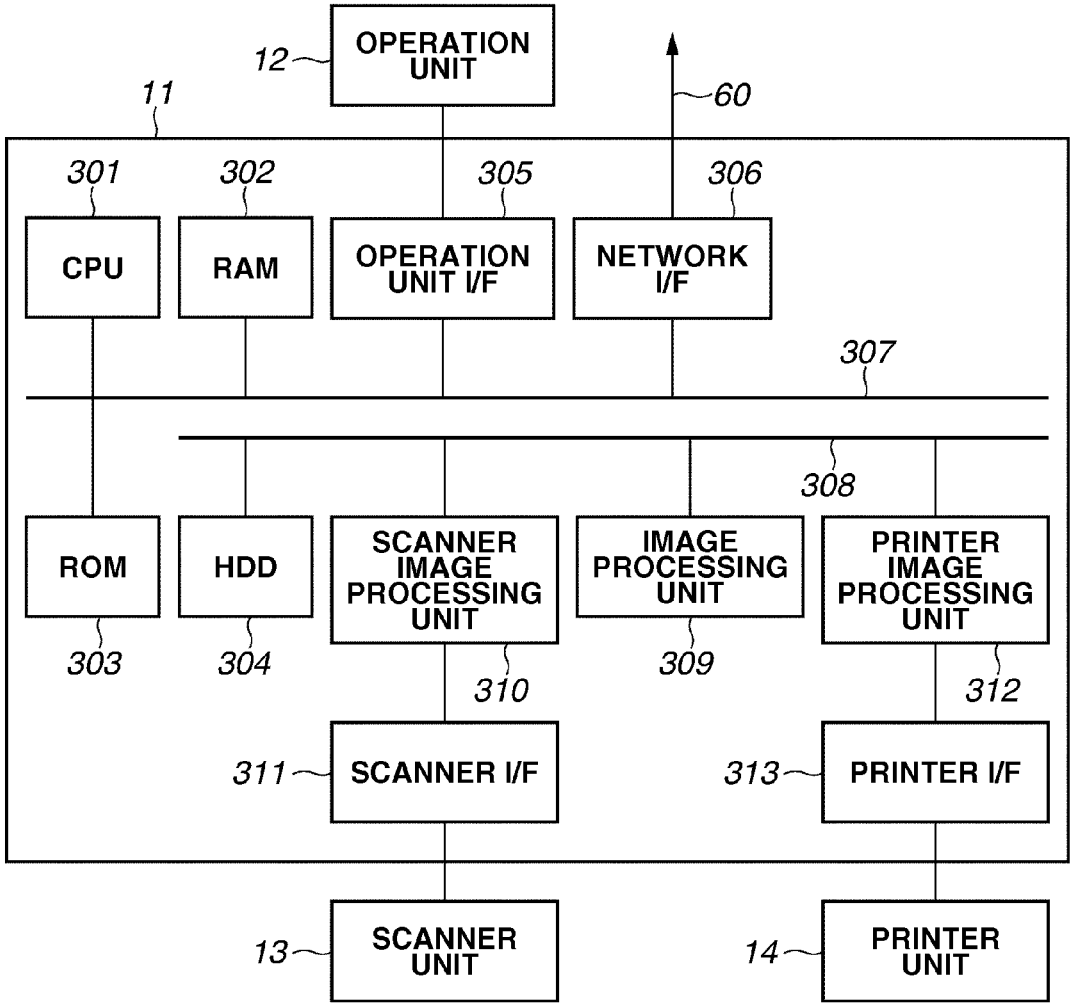
FIG. 3 is a block diagram illustrating a configuration of a controller 11 of the image forming apparatus 10 in more detail.

FIG. 3 is a block diagram illustrating the configuration of the controller 11 of the image forming apparatus 10 in more detail. The controller 11 is electrically connected to the scanner unit 13 and the printer unit 14. The controller 11 is also connected to the PCs 40 and 50 and an external apparatus via the LAN 60 and the like. Thus, image data and device information can be input into and output from the controller 11.

A central processing unit (CPU) 301 comprehensively controls access to various connected devices according to a control program or the like stored in a read only memory (ROM) 303. The CPU 301 also comprehensively controls various types of processing executed in the controller 11 according to a control program or the like stored in the ROM 303.

A random access memory (RAM) 302 is a system work memory used by the CPU 301 to operate. The RAM 302 is also a memory used to temporarily store image data. The RAM 302 includes a static random access memory (SRAM), which holds stored content even after a power source is turned off, and a dynamic random access memory (DRAM), in which stored content is erased after a power source is turned off.

The ROM 303 stores device boot programs and the like. A hard disk drive (HDD) 304 is capable of storing system software and image data.

An operation unit I/F 305 is an interface unit configured to connect the operation unit 12 to a system bus 307. The operation unit I/F 305 receives image data to be displayed on the operation unit 12 from the system bus 307 and outputs the image data to the operation unit 12. Further, the operation unit I/F 305 outputs information input via the operation unit 12 to the system bus 307.

A network I/F 306 is connected to the LAN 60 and the system bus 307. The network I/F 306 inputs and outputs information to control communications between the image forming apparatus 10 and the network. An image bus 308 is a transmission path configured to transmit and receive image data. The image bus 308 includes a peripheral component interconnect (PCI) bus or IEEE 1394 bus.

An image processing unit 309 is configured to execute image processing. The image processing unit 309 is capable of reading image data stored in the RAM 302 to execute image processing extension or reduction such as a joint photographic experts group (JPEG) image and a joint bi-level image experts group (JBIG) image and color correction.

A scanner image processing unit 310 executes correction, processing, and editing on image data received from the scanner unit 13 via a scanner I/F 311. The scanner image processing unit 310 determines whether received image data is a color document or a monochrome document and whether the received image data is a text document or a photographic document. The scanner image processing unit 310 attaches the determination results to the image data. Such attached information is referred to as attribute data.

A printer image processing unit 312 executes image processing on image data by reference to attribute data attached to the image data. Image data on which the image processing has been executed is output to the printer unit 14 via a printer I/F 313. Although FIG. 3 does not illustrate, the controller 11 also includes a hardware configuration regarding the power supply control (FIG. 8) and the like.

Figure 4A:
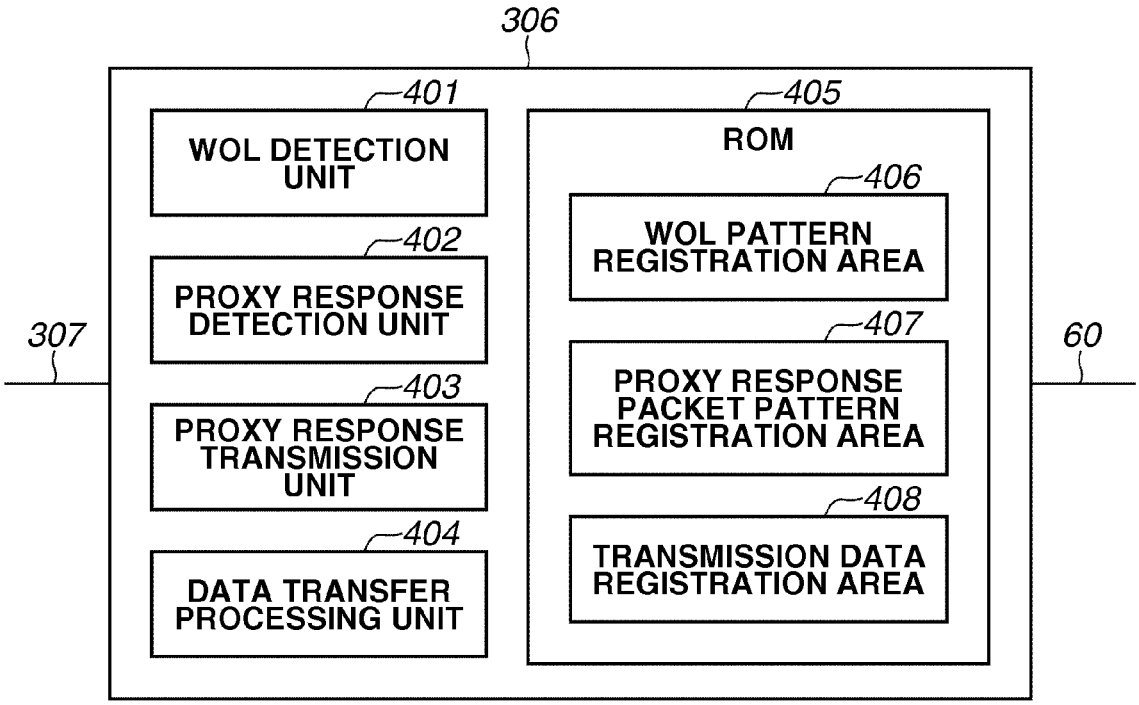
FIGS. 4A and 4B are block diagrams each illustrating the configuration of a network interface (I/F) 306 in more detail.

FIG. 4A is a block diagram illustrating the configuration of the network I/F 306 in more detail. The network I/F 306 includes, in terms of processing functions, a Wake-on-LAN (WOL) detection unit 401, a proxy response detection unit 402, a proxy response transmission unit 403, a data transfer processing unit 404, and a ROM 405.

The ROM 405 in the network I/F 306 includes a WOL pattern registration area 406, a proxy response reception packet pattern registration area 407, and a transmission data registration area 408.

The WOL detection unit 401 compares a pattern stored in the WOL pattern registration area 406 with a pattern of a packet received from the network 60 while the CPU 301 is in the sleep state. As a result of the comparison, if the patterns match, the WOL detection unit 401 executes output such as interruption to the CPU 301 to activate the CPU 301.

The proxy response detection unit 402 compares a pattern stored in the proxy response reception packet pattern registration area 407 with a pattern of a packet received from the network 60 while the CPU 301 is in the sleep state. As a result of the comparison, if the patterns match, the proxy response detection unit 402 notifies the proxy response transmission unit 403 that the patterns match. The proxy response reception packet pattern registration area 407 stores a list of packets to be compared with packets received via the network 60.

In response to the notification from the proxy response detection unit 402, the proxy response transmission unit 403 sends a packet with a packet pattern stored in the transmission data registration area 408 to the network 60. When the proxy response transmission unit 403 sends a packet to the network 60, the proxy response transmission unit 403 can generate a destination address and calculate a checksum of a packet to put the information into the packet.

The data transfer processing unit 404 transfers to the RAM 302 data received from the network 60 in response to an instruction from the CPU 301. The data transfer processing unit 404 executes processing to transmit data existing in the RAM 302 to the network 60.

A CPU 410 (FIG. 4B) in the network I/F 306 reads and executes a program stored in, for example, the ROM 405 or another storage device (flash memory, etc.), which is not illustrated, in the network I/F 306 to realize the WOL detection unit 401, the proxy response detection unit 402, the proxy response transmission unit 403, and the data transfer processing unit 404 as processing functions. The power consumption of the CPU 410 (FIG. 4B) in the network I/F 306 is assumed to be lower than the power consumption of the CPU 301.

Figure 4B:
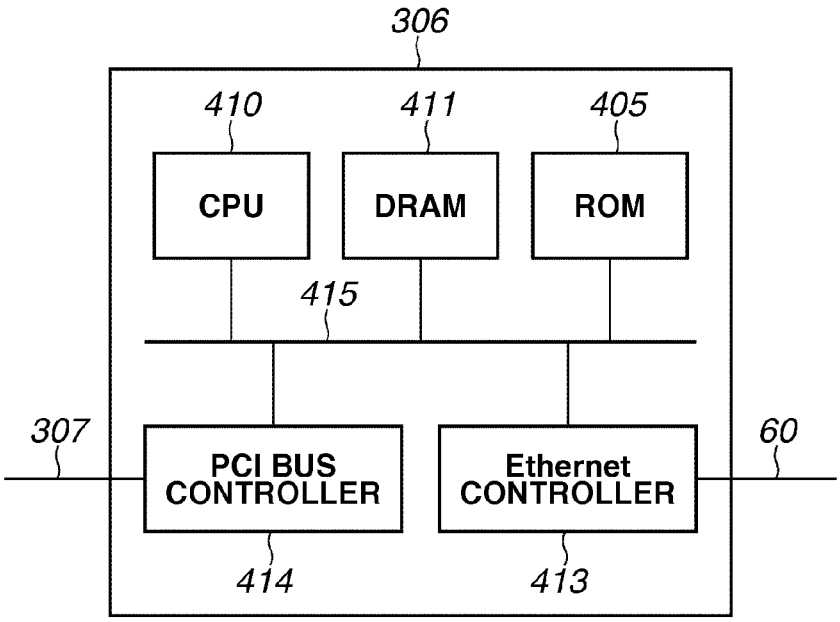

FIG. 4B is a hardware block diagram illustrating the network I/F 306. The network I/F 306 includes the CPU 410, a DRAM 411, the ROM 405, an Ethernet controller 413, a PCI bus controller 414, and a system bus 415 connecting the foregoing blocks together. The network I/F 306 may be provided on aboard on which the CPU 301 and the RAM 302 are provided or on a different board from the board on which the CPU 301 and the RAM 302 are provided.

The CPU 410 comprehensively controls operations of each unit of the network I/F 306. The CPU 410 functions as the WOL detection unit 401 and the proxy response detection unit 402. The CPU 410 accesses the DRAM 411 and the ROM 405 via the system bus 415. The DRAM 411 is a readable and writable memory. A control program of the network I/F 306 uses the DRAM 411. The ROM 405 includes the WOL pattern registration area 406, the proxy response reception packet pattern registration area 407, and the transmission data registration area 408.

The Ethernet controller 413 is connected to Ethernet (registered trademark, omitted hereinafter), which is a well-known networking interface standard. The Ethernet controller 413 receives via the network 60 multicast packets, broadcast packets and the like transmitted from host devices such as the host computers 40 and 50 and other external apparatuses connected to the network 60. The Ethernet controller 413 transmits packets to host devices such as the host computers 40 and 50 and other external apparatuses connected to the network 60. The Ethernet controller 413 includes a direct memory access (DMA) circuit (not illustrated) to be capable of DMA transferring data received from an external network into the DRAM 411. The Ethernet controller 413 is also capable of transmitting data present in the DRAM 411 to a network by DMA transferring. The Ethernet controller 413 functions as the proxy response transmission unit 403. The Ethernet controller 413 also includes a circuit to be connected to a physical layer of the network. Although the present exemplary embodiment describes the configuration in which the network I/F 306 includes the Ethernet controller 413 to be connected to the Ethernet, the network I/F 306 may be connected to a network based on a standard other than the Ethernet.

The PCI bus controller 414 functions as the data transfer processing unit 404. The PCI bus controller 414 accesses the DRAM 411 and the ROM 405 via the system bus 415. Although the present exemplary embodiment describes the configuration in which the network I/F 306 includes the PCI bus controller 414 to be connected to the PCI bus, the network I/F 306 may be connected to a bus based on a standard other than the PCI bus.

Figure 5:
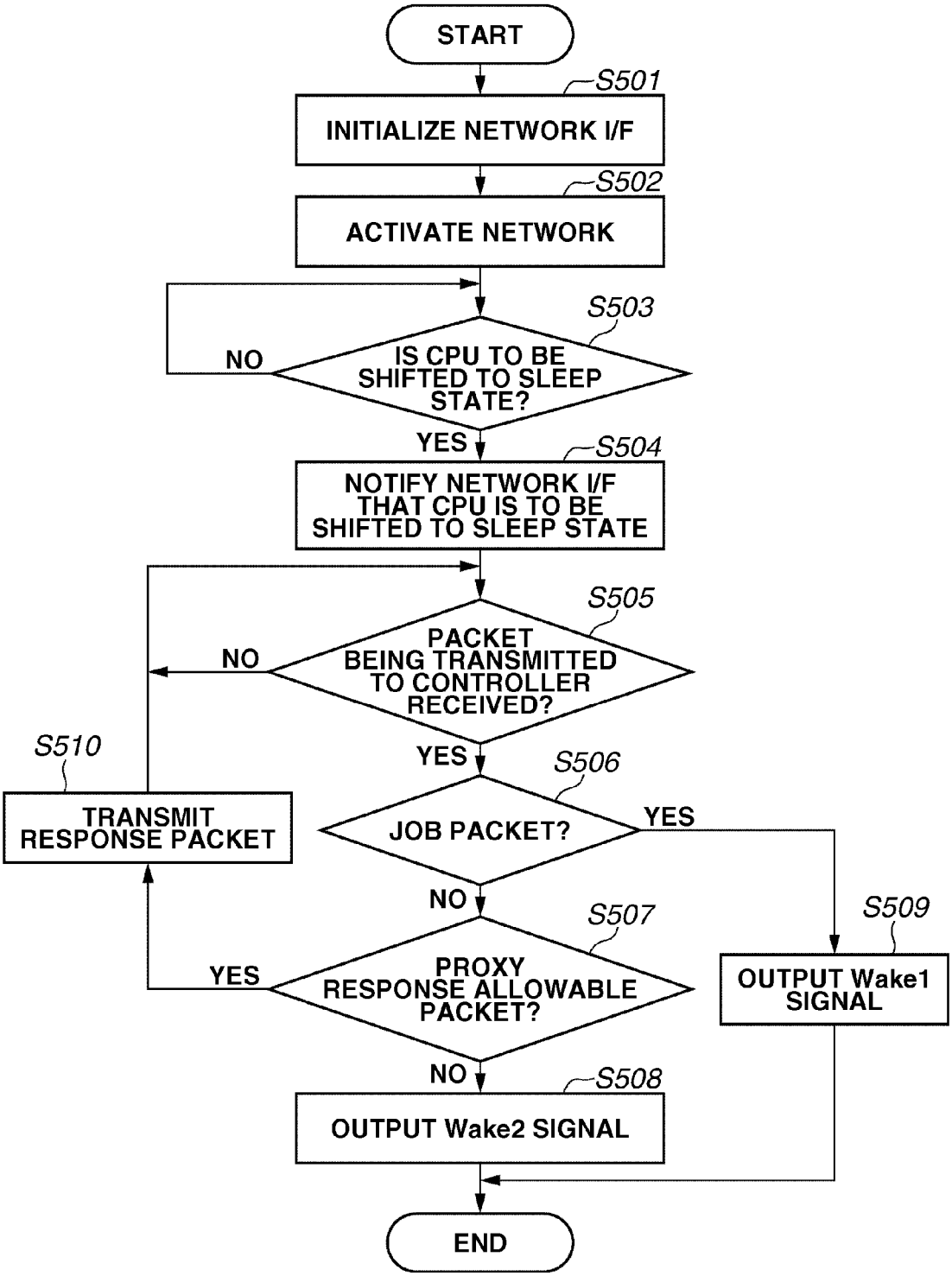
FIG. 5 is a flow chart illustrating an example of processing to be executed by the controller 11.

The following describes, with reference to the flow chart illustrated in FIG. 5, processing including setting the CPU 301 to allow the CPU 301 to use the network 60, shifting the CPU 301 to the sleep state, receiving a packet via the network 60, analyzing the packet, and then recovering the controller 11 based on the analysis result.

FIG. 5 is a flow chart illustrating an example of processing executed by the controller 11. Steps S501 to S504 correspond to processing to be executed by the CPU 301. The CPU 301 realizes the processing to be executed by the CPU 301 by reading and executing a program stored in the ROM 303 or the HDD 304. Steps S505 to S510 correspond to processing to be executed by the network I/F 306. The CPU 410 in the network I/F 306 reads and executes a program stored in the ROM 405 or the like to realize the processing to be executed by the network I/F 306.

In step S501, the CPU 301 executes writing on a register of the network I/F 306 via the system bus 307 to initialize the network I/F 306 and complete the setting to transmit and receive data via the network 60.

In step S502, the CPU 301 executes writing on the register of the network I/F 306 via the system bus 307 to activate the network I/F 306 so that the network I/F 306 transmits and receives data via a buffer area for network transfer that is reserved in advance in the RAM 302. At this time, the CPU 301 operates based on an operating system (hereinafter "OS") stored in the RAM 302. As to the transmission and reception of data to and from the network 60, data can be received from or transmitted to the network 60 by application software running on the RAM 302 via the OS. Transfer of data by the application software is executed via the data transfer processing unit 404 in the network I/F 306.

The image forming apparatus 10 is shifted to the sleep state to reduce power consumption if, for example, neither printing nor scanning has been instructed for a predetermined period or longer (if a sleep state shift condition is satisfied).

In step S503, the CPU 301 executes monitoring to determine whether the CPU 301 executed printing and/or scanning within the predetermined period using the software running on the RAM 302. If the CPU 301 determines that the CPU 301 executed printing and/or scanning within the predetermined period, the CPU 301 determines that the CPU 301 is not to be shifted to the sleep state (NO in step S503). Then, the CPU 301 returns the processing to step S503 to continue the monitoring.

On the other hand, if the CPU 301 determines that the CPU 301 did not execute printing and/or scanning within the predetermined period, the CPU 301 determines that the CPU 301 is to be shifted to the sleep state (YES in step S503), and the processing proceeds to step S504. In the sleep state, neither an operating clock nor power is supplied to the CPU 301 and circuits other than areas such as the RAM 302 where necessary information is saved, whereby power consumption can be reduced.

In step S504, before the CPU 301 is shifted to the sleep state, the CPU 301 executes writing on the register of the network I/F 306 via the system bus 307 to notify the network I/F 306 that the CPU 301 is to be shifted to the sleep state. When the network I/F 306 is notified that the CPU 301 is to be shifted to the sleep state, the network I/F 306 sets the WOL detection unit 401, the proxy response detection unit 402, and the proxy response transmission unit 403 illustrated in FIG. 4A to an operable state. This enables the network I/F 306 to recover the CPU 301 when the network I/F 306 receives a packet for shifting the CPU 301 to a normal operation state while the CPU 301 is in the sleep state. The network I/F 306 is also enabled to make a proxy response when the network I/F 306 receives a proxy response packet in place of the CPU 301 without using the CPU 301.

In step S505, the network I/F 306 monitors reception of packets transmitted with respect to the controller 11 via the network 60. The network I/F 306 continues the monitoring of reception of packets in step S505 until the network I/F 306 receives a packet transmitted with respect to the controller (while NO in step S505).

When the network I/F 306 determines that the network I/F 306 receives a packet transmitted with respect to the controller 11 (YES in step S505), the network I/F 306 moves the processing to step S506 to execute analysis of the packet. The following describes packets used in network communications.

Figure 6:
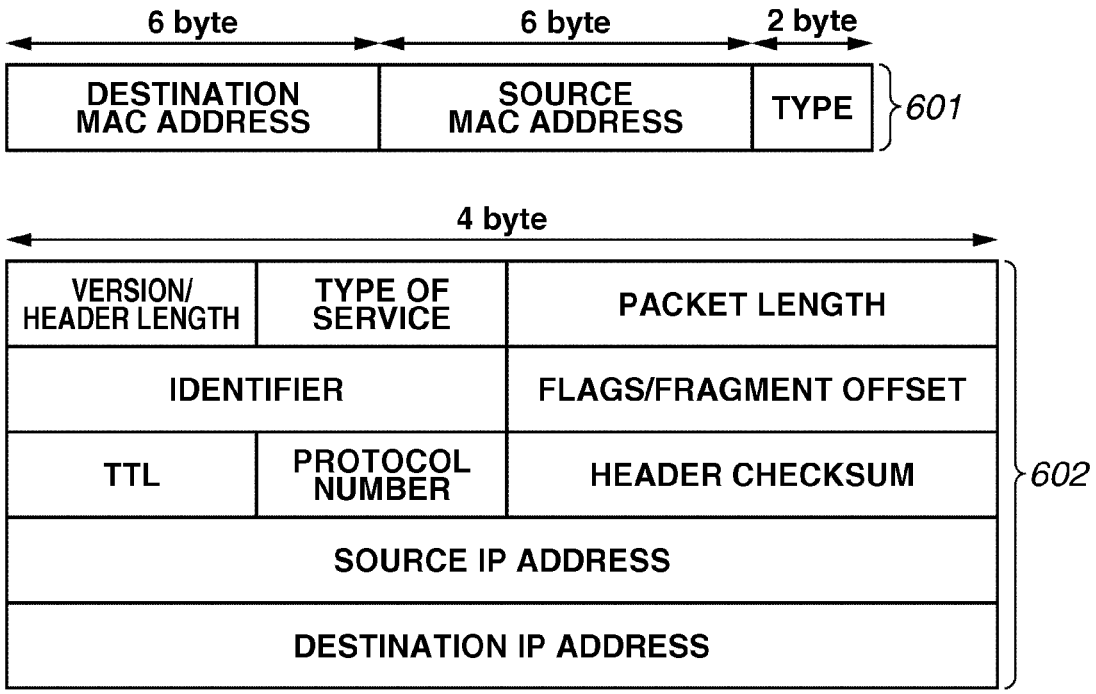
FIG. 6 is a view illustrating an example of a packet format used in network communication.
Figure 7:
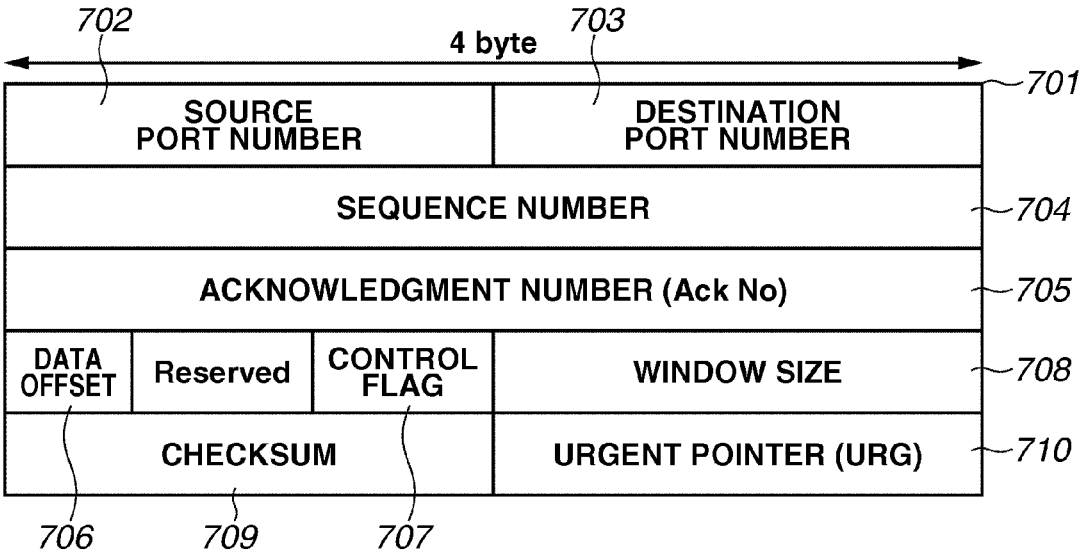
FIG. 7 is a view illustrating an example of a packet format used in network communication.

FIG. 6 is a view illustrating an example of a packet format used in network communications. As illustrated in FIG. 6, a network communication packet includes an Ether header 601 followed by an IP header 602. Packets that require a connection include, in general, transmission control protocol (TCP) packets. A TCP packet includes the Ether header 601 and the IP header 602 followed by a TCP packet header (FIG. 7) and data (not illustrated). Details of a TCP packet are illustrated in FIG. 7. The TCP specification is defined in the RFC 793.

FIG. 7 is a view illustrating the TCP packet format used in communications that require a connection. In general, a TCP header 701 exists in communications that require a connection. The connection is managed using information contained in the TCP header 701. The management of connection refers to execution of controls to assure reliability of communications, including an order control of communication packets sent and received within the connection, re-transmission control executed at the time of packet loss, packet flow control, control to avoid congestion, and the like.

A source port number 702 is 2 bytes long and indicates a port number of a sender side of a communication packet. A destination port number 703 is 2 bytes long and indicates a port number of a receiver side of a communication packet. In a case of communications that require a connection, the source port number 702 and the destination port number 703 are fixed values unless the connection is closed or changed.

A sequence number 704 is 4 bytes long and indicates the location of data of a transmitted packet. Each time data is transmitted, the sequence number 704 is increased by a value corresponding to the size of the transmitted data. An acknowledgement number (Ack No.) 705 is 4 bytes long and indicates the sequence number of data to be received next. Accordingly, if the sequence number 704 of a packet to be sent next by a sender side is the same as the acknowledgement number 705 of a received packet, this indicates that communication up to that point has been performed normally.

A data offset 706 is 4 bits long and indicates where a data portion field begins in a TCP packet. Control flags 707 are 6 bits long and indicate control information on a TCP packet. The control flags 707 include URG (urgent data is contained), ACK (the value of the acknowledgement number 705 is valid), PSH (received data is pushed to a higher level application protocol), RST (the connection is forcibly cut for some reason), SYN (connection establishment request), and FIN (no more data to be sent hereafter, connection termination request), each of which is 1 bit long. In cases of communications that require a connection, the connection is managed by controlling the control flags 707 for each communication sequence.

A window size 708 is 2 bytes long and indicates the size of data that can be received next from a point specified by the value of the acknowledgement number 705. A sender side is not allowed to send data exceeding the value of the window size 708. The value of the window size 708 is changed dynamically according to a state of a packet processed at the receiver side for each communication sequence, the size of a receiving buffer prepared at the receiver side, the settings of the protocol stack at the receiver side, and the like.

A checksum 709 is 2 bytes long and provides reliability of the header portion and data portion of the TCP packet. A sender side computes the checksum 709 for each packet to add the checksum 709 to the packet for which the checksum 709 has been computed. A receiver side checks the checksum.

709 of a received packet to determine if the packet has been damaged through the communication path.

An urgent pointer (URG) 710 is 2 bytes long and indicates a storage location pointer for an urgent data. Each application at the receiver side determines an operation to be executed when the receiver receives urgent data. According to the individual contents of the TCP packet described above, in a case of performing communications that require a connection, there exist fields in which values are changed dynamically for each communication sequence.

The description of the flowchart illustrated in FIG. 5 is resumed as follows. In step S506, the WOL detection unit 401 of the network I/F 306 determines whether the received packet transmitted with respect to the controller 11 is a job packet that requires supply of power to the printer unit 14 and the scanner unit 13. In this determination, the WOL detection unit 401 compares a pattern of the received packet with a pattern stored in the WOL pattern registration area 406. In this case, the WOL detection unit 401 determines whether the pattern of the received TCP packet matches a pattern with a destination port number of "8000" or "8001" among the patterns stored in the WOL pattern registration area 406.

If the destination port number 703 of the received packet is "8000" or "8001" (YES in step S506), then the WOL detection unit 401 determines that the received packet is a job packet. On the other hand, if the destination port number 703 of the received packet is neither "8000" nor "8001" (NO in step S506), then the WOL detection unit 401 determines that the received packet is not a job packet.

If the WOL detection unit 401 determines that the received packet is a job packet (print packet) (YES in step S506), then the WOL detection unit 401 of the network I/F 306 moves the processing to step S509. In step S509, the WOL detection unit 401 outputs a Wake1 signal 802 (FIG. 8), which will be described later, to the power supply control unit 801. Then, the processing of the flow chart is ended.

On the other hand, in step S506, if the WOL detection unit 401 determines that the received packet is not a job packet (NO in step S506), then the network I/F 306 moves the processing to step S507.

In step S507, the proxy response detection unit 402 of the network I/F 306 determines whether the received packet is a proxy response allowable packet. In this determination processing, the proxy response detection unit 402 compares the pattern of the received packet with a pattern stored in the proxy response reception packet pattern registration area 407. If the patterns match (YES in step S507), the proxy response detection unit 402 determines that the received packet is a proxy response allowable packet. On the other hand, if the patterns fail to match, the proxy response detection unit 402 determines that the received packet is not a proxy response allowable packet.

If the proxy response detection unit 402 determines that the received packet is a proxy response allowable packet (YES in step S507), then the proxy response detection unit 402 notifies the proxy response transmission unit 403. In step S510, the proxy response transmission unit 403 having received the notification sends a response packet to the network 60 using a pattern string stored in the proxy response reception packet pattern registration area 407. Then, the processing returns to step S505.

On the other hand, in step S507, if the proxy response detection unit 402 determines that the received packet is not a proxy response allowable packet (NO in step S507), then the proxy response detection unit 402 moves the processing to step S508. That is to say, if the received packet is a proxy response unallowable packet (first type packet), which is neither a job packet (second type packet) nor a proxy response allowable packet (third type packet), then the processing proceeds to step S508.

In step S508, the proxy response detection unit 402 outputs a Wake2 signal 803 (FIG. 8), which will be described later, to the power supply control unit 801. Then the processing illustrated in the flow chart ends. The order of steps S506 and S507 may be reversed.

As the foregoing describes, when the network I/F 306 receives a packet from the network 60 during the sleep state to recover from the sleep state, the network I/F 306 transmits to the power supply control unit 801 a recovery signal (Wake1 signal 802, Wake2 signal 803) corresponding to the type of the packet.

Figure 8:
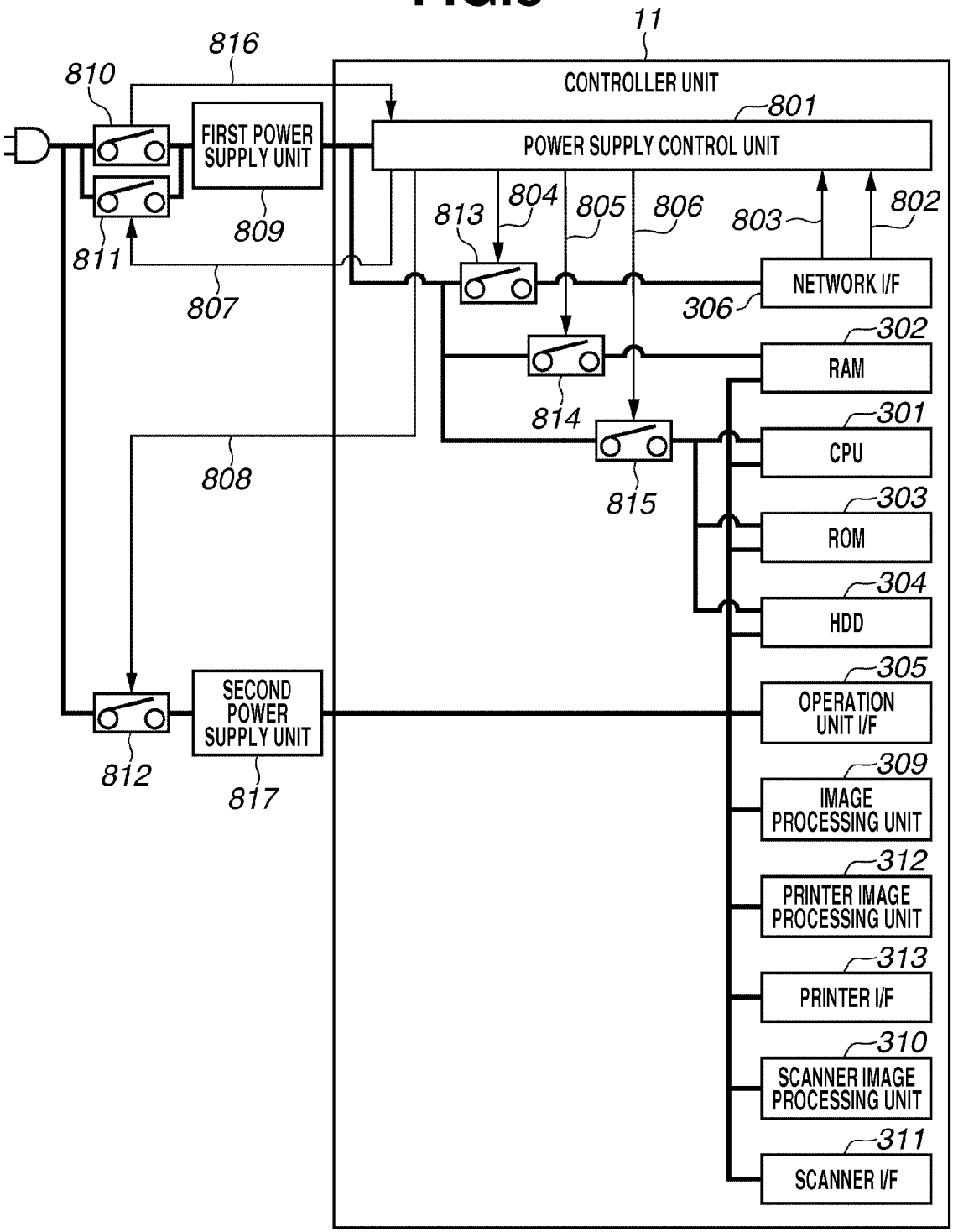
FIG. 8 is a block diagram illustrating an example of a hardware configuration regarding the power supply control of the controller 11.

The following describes the hardware configuration regarding the power supply control of the controller 11. FIG. 8 is a block diagram illustrating an example of the hardware configuration regarding the power supply control of the controller 11. The power supply control unit 801 receives commands from the CPU 301, signals for detection of recovery from the sleep state from the network I/F 306 (Wake1 signal 802, Wake2 signal 803, etc.) and the like. Based on the commands, the power supply control unit 801 controls supply of power from a first power supply unit 809 and a second power supply unit 817 to the respective devices.

The first power supply unit 809 (first power supply unit) supplies, for example, 3.3 V of power (first power). The second power supply unit 817 (second power supply unit) supplies, for example, 12 V of power (second power). In other words, the voltage of the second power supplied by the second power supply unit 817 is higher than the voltage of the first power supplied by the first power supply unit 809.

The power supply control unit 801 controls the supply of power by controlling signals 804 to 808 such that during a standby state in which a job is executable, the second power is supplied to the devices 301 to 304, 305, and 309 to 313 while the first power is supplied to the network I/F 306 and the power supply control unit 801. The power supply control unit 801 also controls the control signals 804 to 808 such that during the sleep state in which power consumption is limited, the supply of power to the devices 301 to 304, 305, and 309 to 313 is stopped while the first power is supplied to the network I/F 306 and the power supply control unit 801. In other words, when the controller 11 is shifted from the standby state to the sleep state, the power supply control unit 801 performs control to block the second power supplied to the devices 301 to 304, 305, and 309 to 313.

The Wake1 signal (first recovery signal) 802 is a signal transmitted from the network I/F 306 to the power supply control unit 801 to notify the power supply control unit 801 of reception of a job packet when the network I/F 306 receives the job packet via the network 60 during the sleep state. When the power supply control unit 801 detects the Wake1 signal 802, the power supply control unit 801 controls the control signals 804 to 808 to select a power supply state with respect to each device (details will be described below).

The Wake2 signal (second recovery signal) 803 is a signal transmitted from the network I/F 306 to the power supply control unit 801 to notify the power supply control unit 801 of reception of a packet that is neither a job packet nor a proxy response allowable packet (e.g., inquiry of the state of the image forming apparatus 10, etc.) when the network I/F 306 receives the packet via the network 60 during the sleep state. When the power supply control unit 801 detects the Wake2 signal 803, the power supply control unit 801 controls the control signals 804 to 808 to select a state of power supply with respect to each device (details will be described below).

The control signals 804 to 808 are signals for performing control whether to supply power to the respective devices. Switches 811 to 815 are controlled by the control signals 804 to 808. The power supply control unit 801 controls the switches 811 to 815 through the control signals 804 to 808 to change a power supply state with respect to each device. The switches 811 to 815 can be realized using a field effect transistor (FET), a relay switch, etc.

The control signal 804 and the switch 813 control the supply of power to the network I/F 306. The switch 813 controls the supply of power such that the power to the network I/F 306 is supplied when the image forming apparatus 10 is in the standby state or in the sleep state, the power to the network I/F 306 is stopped when the image forming apparatus 10 is in an off state. In other words, the switch 813 (first switching unit) switches between supply and stop of power from the first power supply unit 809 to the network I/F 306.

The control signal 805 and the switch 814 control the supply of power from the first power supply unit 809 to the RAM 302. Either one of the first power supply unit 809 or the second power supply unit 817 can supply power to the RAM 302. The power supply control unit 801 selects one of the first power supply unit 809 and the second power supply unit 817 according to the state of the image forming apparatus 10 to supply power to the RAM 302. For example, the first power supply unit 809 supplies power to the RAM 302 when the image forming apparatus 10 is in the sleep state, and the second power supply unit 817 supplies power to the RAM 302 when the image forming apparatus 10 is executing printing operation.

The control signal 806 and the switch 815 control the supply of power from the first power supply unit 809 to the CPU 301, the ROM 303, and the HDD 304. Specifically, the switch 815 (second switching unit) switches between supply and stop of power from the first power supply unit 809 to the CPU 301, the ROM 303, and the HDD 304. Either one of the first power supply unit 809 or the second power supply unit 817 can supply power to the CPU 301, the ROM 303, and the HDD 304. The power supply control unit 801 selects one of the first power supply unit 809 and the second power supply unit 817 according to the state of the image forming apparatus 10 to supply power to the CPU 301, the ROM 303, and the HDD 304. Details of how the power supply control unit 801 selects one of the first power supply unit 809 and the second power supply unit 817 to supply power to the CPU 301, the ROM 303, and the HDD 304 will be described below with reference to FIG. 9, but an example is given as follows. For example, the first power supply unit 809 supplies power to the CPU 301, the ROM 303, and the HDD 304 when the image forming apparatus 10 recovers from the sleep state in response to a recovery factor other than a job packet, and the second power supply unit 817 supplies power to the CPU 301, the ROM 303, and the HDD 304 when the image forming apparatus 10 recovers from the sleep state in response to a job packet.

The control signal 807 and the switch 811 control the supply of AC power to the first power supply unit 809. The power supply control unit 801 turns on the control signal 807 and the switch 811 when a switch 810 is turned on. Hence, even when a user turns off the switch 810, power can be supplied to the controller 11. At this time, the power supply control unit 801 detects that the switch 810 has been turned off through a signal 816 for obtaining information about whether the switch 810 is on/off. The power supply control unit 801 notifies the CPU 301 that the switch 810 has been turned off, so that the CPU 301 can first execute normal shutdown processing and then shift the power supply to each device to the off state.

The switch 810 is operated by a user to turn on/off the image forming apparatus 10. When a user turns on the switch 810, the supply of AC power to the first power supply unit 809 is started.

The control signal 808 and the switch 812 control the supply of AC power to the second power supply unit 817. The control signal 808 and the switch 812 also control the supply of power from the second power supply unit 817 to each device. For example, as to the supply of power to the image processing unit 309, when the image forming apparatus 10 is in the sleep state, the switch 812 is turned off to stop the supply of power from the second power supply unit 817 to the image processing unit 309. On the other hand, when the image forming apparatus 10 is in the standby state, the switch 812 is turned on to supply power from the second power supply unit 817 to the image processing unit 309. In other words, the power supply control unit 801 controls the switch 812 (third switching unit) to turn on or off the switch 812, so that the supply of power from the second power supply unit 817 is started or stopped.

The first power supply unit 809 converts the AC power into DC power to supply the first power to the power supply control unit 801 and the like. The first power supplied from the first power supply unit 809 is provided to supply power to the power supply control unit 801 and the like even if the image forming apparatus 10 is shifted to the sleep state. The first power is supplied not only to the power supply control unit 801 but also to the network I/F 306 configured to detect an incoming packet from the network 60 to recover the image forming apparatus 10 from the sleep state.

The second power supply unit 817 converts the AC power into DC power to supply the second power to each device. The supply of the second power, which is supplied from the second power supply unit 817, is stopped when the image forming apparatus 10 is in the sleep state. The second power supply unit 817 is provided to reduce power consumption during the sleep state. The second power supply unit 817 is configured to supply power to devices that do not need the supply of power when the image forming apparatus 10 is in the sleep state.

Figure 9:
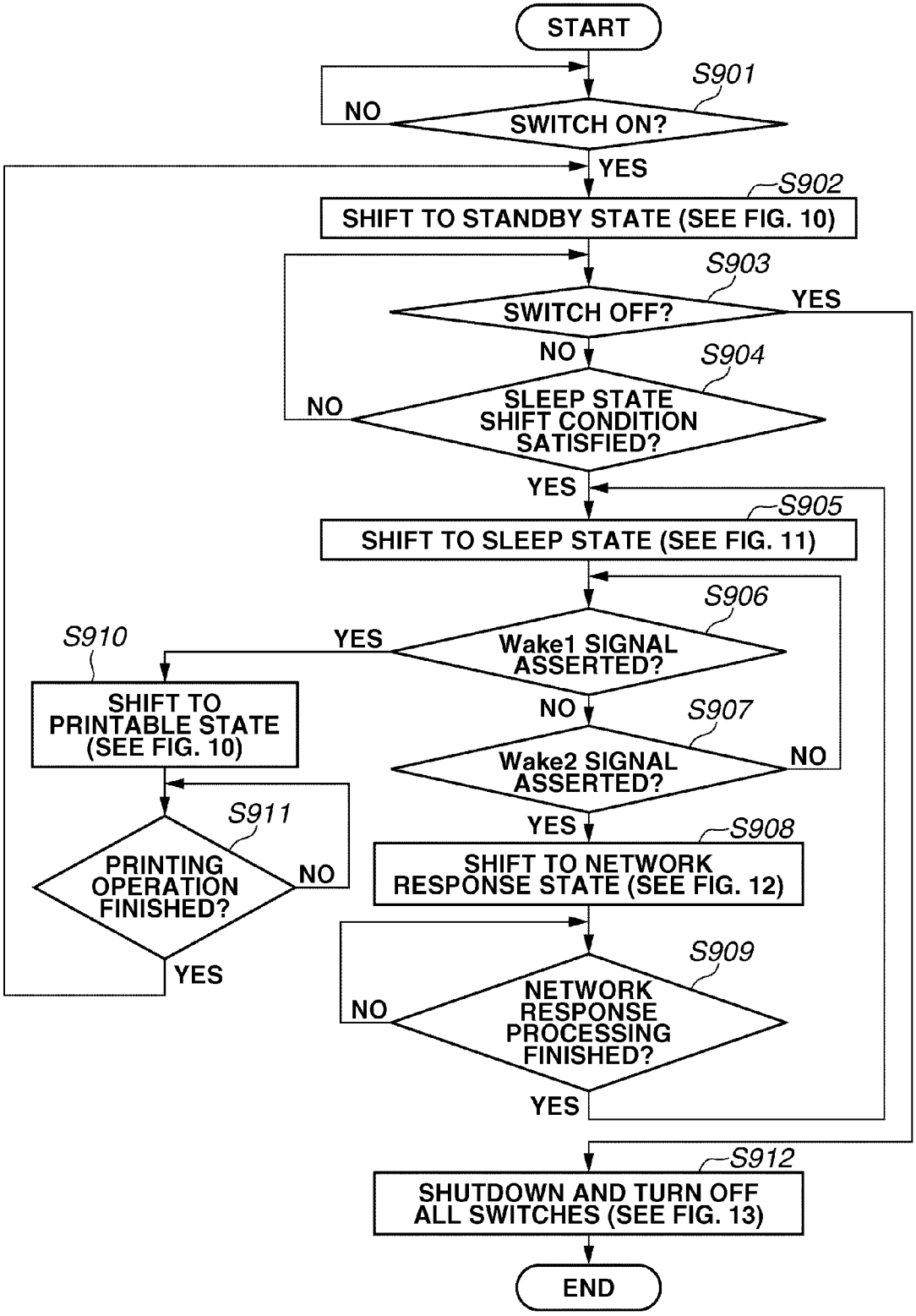
FIG. 9 is a flow chart illustrating an example of power supply control processing to be executed by a power supply control unit 801.

The following describes how the power supply control unit 801 controls the supply of power to each device, with reference to the flow chart illustrated in FIG. 9. Specifically, the following describes processing including shifting the image forming apparatus 10 from a power-on state to the sleep state, receiving a return packet transmitted via the network 60 by the network I/F 306, and then recovering the image forming apparatus 10 from the sleep state.

FIG. 9 is a flow chart illustrating an example of power supply control processing executed by the power supply control unit 801. FIGS. 10 to 13 are views each illustrating an example of the power supply state of the controller 11. The CPU 301 realizes the processing illustrated in FIG. 9 that is to be executed by the CPU 301 reading and executing a program stored in the ROM 303 or the HDD 304. The power supply control unit 801 may be, for example, a one-chip microcomputer including a single integrated circuit (IC) chip on which a microprocessor, a RAM, a ROM, various types of input and output devices and the like are mounted, a programmable logic device (PLD), an application specific integrated circuit (ASIC), a logic circuit, or any other configuration. The power supply control unit 801 may have any configuration that can realize the processing illustrated in FIG. 9 that is to be executed by the power supply control unit 801.

When a user turns on the switch 810 (YES in step S901), in step S902, power is supplied to the power supply control unit 801 to shift the image forming apparatus 10 to the standby state. Specifically, when the power is supplied to the power supply control unit 801, the power supply control unit 801 controls the control signals 804 to 808 to turn on the switches 813, 811, and 812 and turn off the switches 814 and 815. As a result, power is supplied to every one of the devices illustrated in FIG. 8. To the RAM 302, the CPU 301, the ROM 303, and the HDD 304, to which either one of the first power supply unit 809 or the second power supply unit 817 can supply power (refer to FIG. 10), the second power supply unit 817 is supplying the power. As a result, the image forming apparatus 10 is shifted to the standby state. Up to the point when the switch 810 is turned on, no power is supplied to the power supply control unit 801 and, thus, the control signals 804 to 808 are controlled to keep the switches 811 to 815 in the off state.

In step S903, the CPU 301 determines whether the power has been turned off. Specifically, when the power supply control unit 801 detects that a user has turned off the switch 810 through the signal 816 (YES in step S903), the power supply control unit 801 notifies the CPU 301 that the user has turned off the switch 810. When the CPU 301 receives this notification, the CPU 301 determines that the power has been turned off. Unless the CPU 301 receives the notification (NO in step S903), the CPU 301 determines that the power has not been turned off.

When the CPU 301 determines that the power has been turned off (YES in step S903), the CPU 301 moves the processing to step S912. In step S912, the CPU 301 executes shutdown processing and notifies the power supply control unit 801 of the execution of the shutdown processing. When the power supply control unit 801 receives the notification of the execution of the shutdown processing from the CPU 301, the power supply control unit 801 controls the control signals 804 to 808 to turn off the switches 811 to 815, so that the supply of power to every one of the devices is stopped (refer to FIG. 13).

On the other hand, in step S903, if the CPU 301 determines that the power has not been turned off (NO in step S903), the CPU 301 moves the processing to step S904. In step S904, the CPU 301 determines whether the image forming apparatus 10 is to be shifted to the sleep state. If the CPU 301 determines that a sleep state shift condition is not satisfied, the CPU 301 determines that the image forming apparatus 10 is not to be shifted to the sleep state (NO in step S904). Then, the processing is moved back to step S903. Examples of a sleep state shift condition include shifting to the sleep state by a timer and the like. For example, a case in which neither printing nor scanning has been instructed for a predetermined period or longer.

On the other hand, if the CPU 301 determines that the sleep state shift condition is satisfied, the CPU 301 determines that the image forming apparatus 10 is to be shifted to the sleep state (YES in step S904). Then, the processing is moved to step S905. In step S905, the CPU 301 executes processing to shift the image forming apparatus 10 to the sleep state and sends a notification to the power supply control unit 801 to notify that the image forming apparatus 10 is to be shifted to the sleep state. When the power supply control unit 801 receives the notification from the CPU 301, the power supply control unit 801 controls the control signals 804 to 808 to turn on the switches 811, 813, and 814 and turn off the switches 812 and 815. In other words, when the image forming apparatus 10 is in the sleep state, power is supplied only to the power supply control unit 801, the network I/F 306, and the RAM 302 among the devices illustrated in FIG. 8, and all of the power supply control unit 801, the network I/F 306, and the RAM 302 are receiving the power (3.3 V) from the first power supply unit 809 (first power state) (refer to FIG. 11).

When the image forming apparatus 10 is shifted to the sleep state, in step S906, the power supply control unit 801 executes monitoring to determine whether a Wake1 signal 802, which is output from the network I/F 306, is asserted. When the power supply control unit 801 determines that assertion of the Wake1 signal 802 is detected (YES in step S906), the power supply control unit 801 moves the processing to step S910.

In step S910, the power supply control unit 801 controls the control signals 804 to 808 to turn on the switches 811, 812, and 813 and turn off the switches 814 and 815. In other words, the power supply control unit 801 shifts the image forming apparatus 10 to the same state as the standby state as in step S902 (refer to FIG. 10). As a result, power is supplied to the CPU 301 so that the CPU 301 is recovered to be in a state in which the CPU 301 is ready to execute printing (third power state). The CPU 301 receives a job packet from the network I/F 306 and performs control to execute the job. Although the printing operation has been described based on the assumption that the job packet requires printing, the operation is not limited to the printing operation, and the foregoing also applies to remote scanning and the like.

In step S911, the CPU 301 executes monitoring to determine whether the printing operation executed in step S910 is finished. The CPU 301 repeats the processing of step S911 until the printing operation is finished (while NO in step S910). When the CPU 301 determines that the printing operation is finished (YES in step S911), the CPU 301 moves the processing to step S902.

On the other hand, in step S906, if the power supply control unit 801 determines that assertion of the Wake1 signal 802 is not detected (NO in step S906), the power supply control unit 801 moves the processing to step S907.

In step S907, the power supply control unit 801 determine whether a Wake2 signal 803, which is output from the network I/F 306, is asserted. If the power supply control unit 801 determines that assertion of the Wake2 signal 803 is not detected (NO in step S907), the power supply control unit 801 moves the processing back to step S906. On the other hand, if the power supply control unit 801 determines that assertion of the Wake2 signal 803 is detected (YES in step S907), the power supply control unit 801 moves the processing to step S908.

In step S908, the power supply control unit 801 performs control to shift the image forming apparatus 10 to a network response state. Specifically, the power supply control unit 801 controls the control signals 804 to 808 to turn on the switches 811, 813, 814, and 815 and turn off the switch 812. In other words, when the image forming apparatus 10 is in the network response state, power is supplied only to the power supply control unit 801, the network I/F 306, the RAM. 302, the CPU 301, the ROM 303, and the HDD 304 among the devices illustrated in FIG. 8, and all of the power supply control unit 801, the network I/F 306, the RAM. 302, the CPU 301, the ROM. 303, and the HDD 304 are receiving the power (3.3 V) from the first power supply unit 809 (second power state) (refer to FIG. 12). As a result, power is supplied to the CPU 301 so that the CPU 301 is recovered to be in a state in which the CPU 301 is ready to execute responding operation. The CPU 301 receives from the network I/F 306 a packet that is a proxy response unallowable packet and not a job packet (e.g., inquiry of the status of the image forming apparatus 10, etc.) and executes responding operation corresponding to the packet. Although the power is supplied to the HDD 304 in the foregoing case, if the CPU 301 can respond to a network packet even if no power is supplied to the HDD 304, it is not necessary to supply power to the HDD 304.

In step S909, the CPU 301 determines whether the network response processing is finished. Until the network response processing is finished (while NO in step S909), the CPU 301 repeats the processing of step S909. If the CPU 301 determines that the network response processing is finished (YES in step S909), the CPU 301 moves the processing to step S905 to shift the image forming apparatus 10 to the sleep state again.

As the foregoing describes, a received packet is determined at the network I/F 306, and the Wake signal to be output to the power supply control unit 801 is switched according to the determination result. This enables the power supply control unit 801 to supply power only to the devices that need the supply of power at the time of recovery, and also enables the power supply control unit 801 to switch a power supply unit to supply power, whereby an optimum recovery state can be created to reduce unnecessary power consumption.

Figure 10:
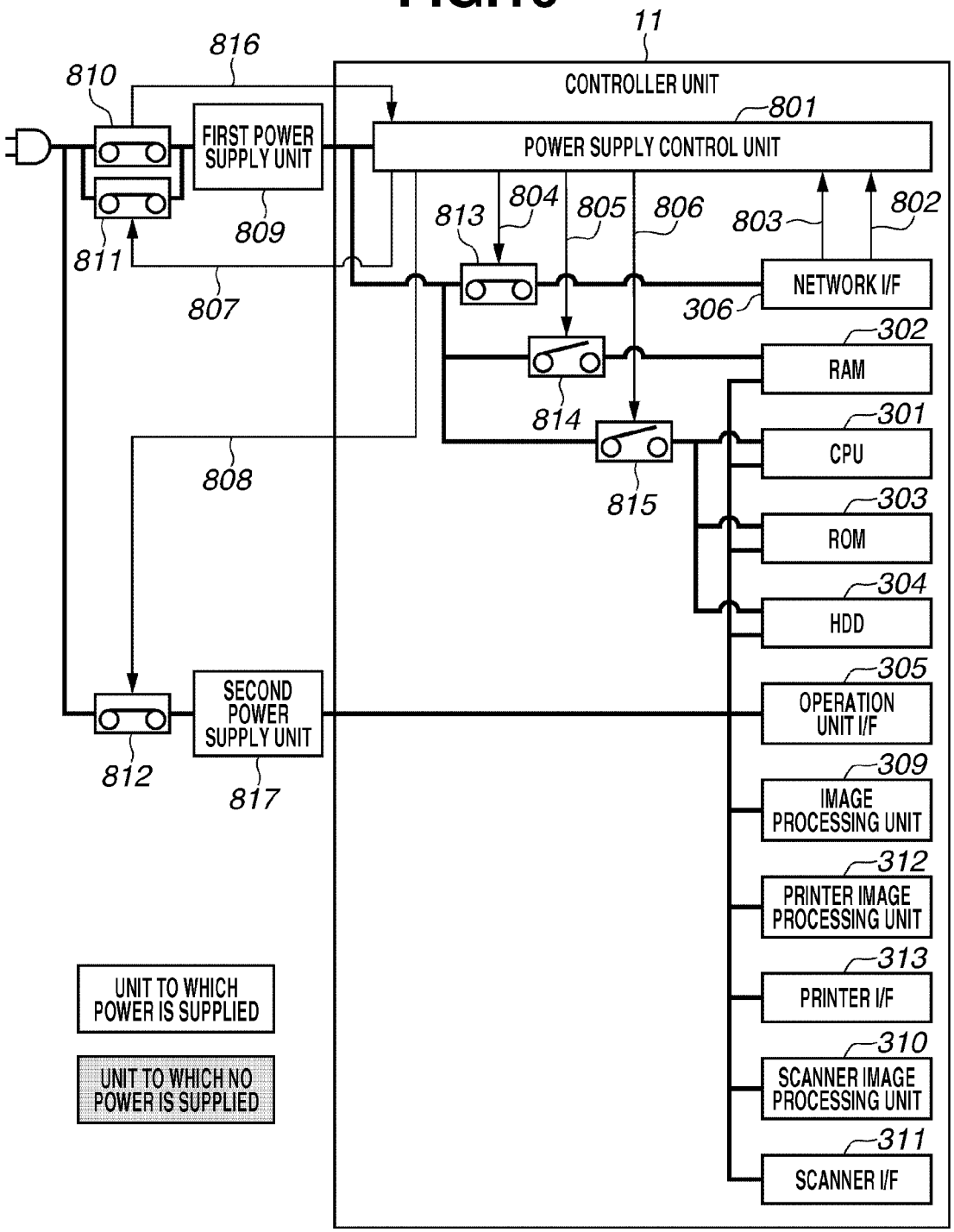
FIG. 10 is a view illustrating an example of the power supply state of the controller 11.
Figure 11:
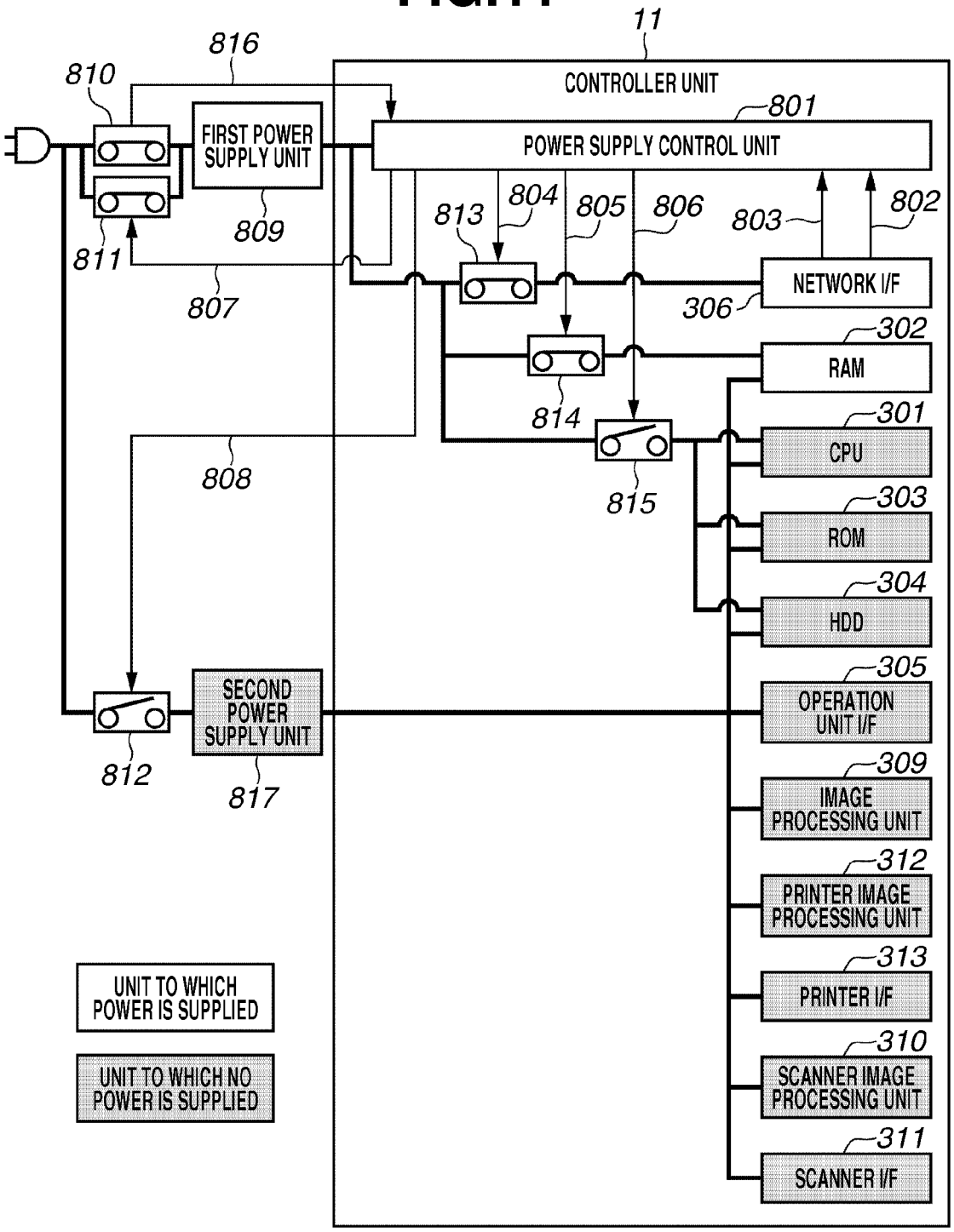
FIG. 11 is a view illustrating an example of the power supply state of the controller 11.

For example, when a job packet is received at the network I/F 306, the power supply control unit 801 supplies power to every one of the devices. At this time, the power supply control unit 801 controls the second power supply unit 817 to supply the second power (12 V) to the RAM 302, the CPU 301, the ROM 303, and the HDD 304, to which either one of the first power supply unit 809 and the second power supply unit 817 can supply power (FIG. 10).

Figure 12:
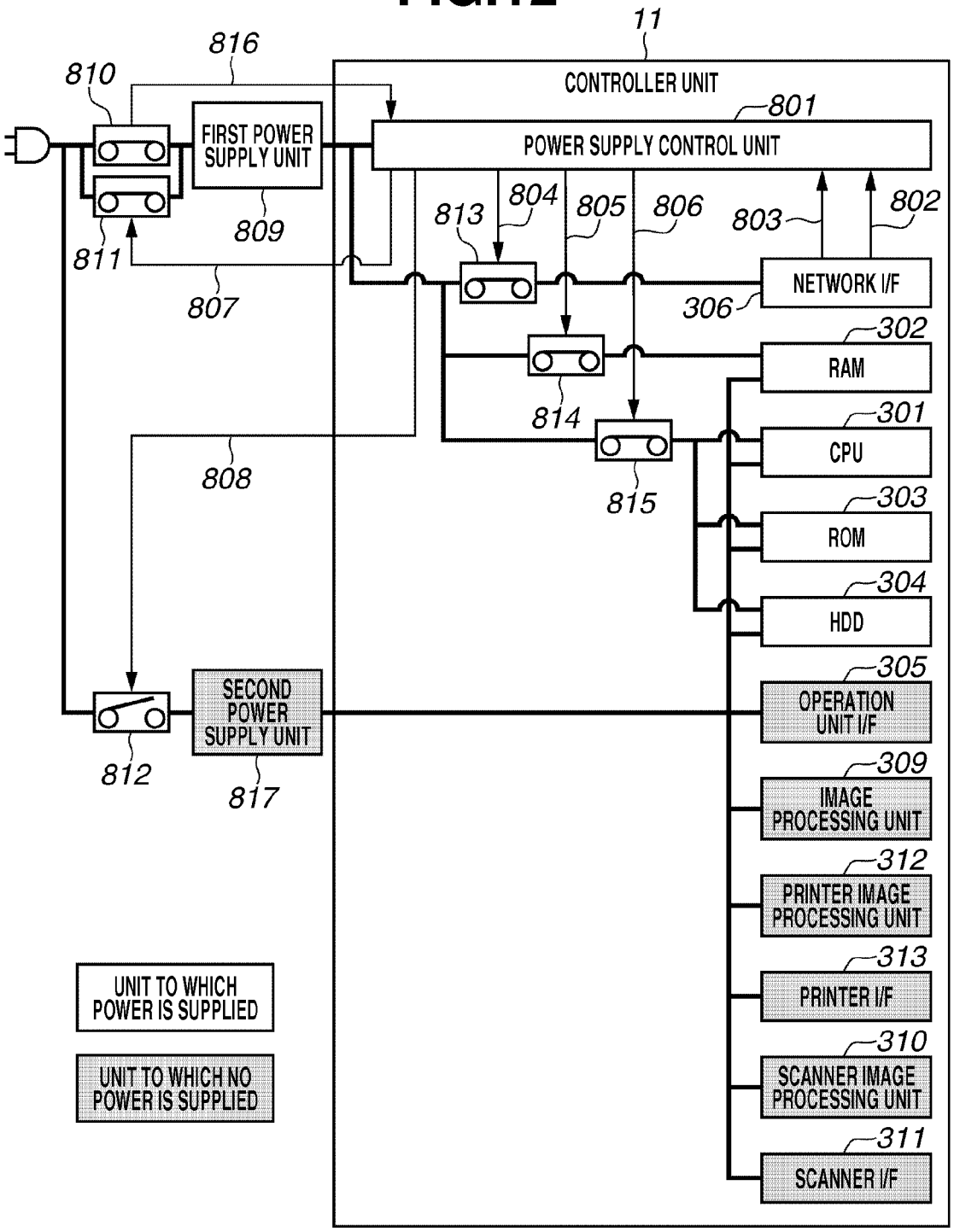
FIG. 12 is a view illustrating an example of the power supply state of the controller 11.
Figure 13:
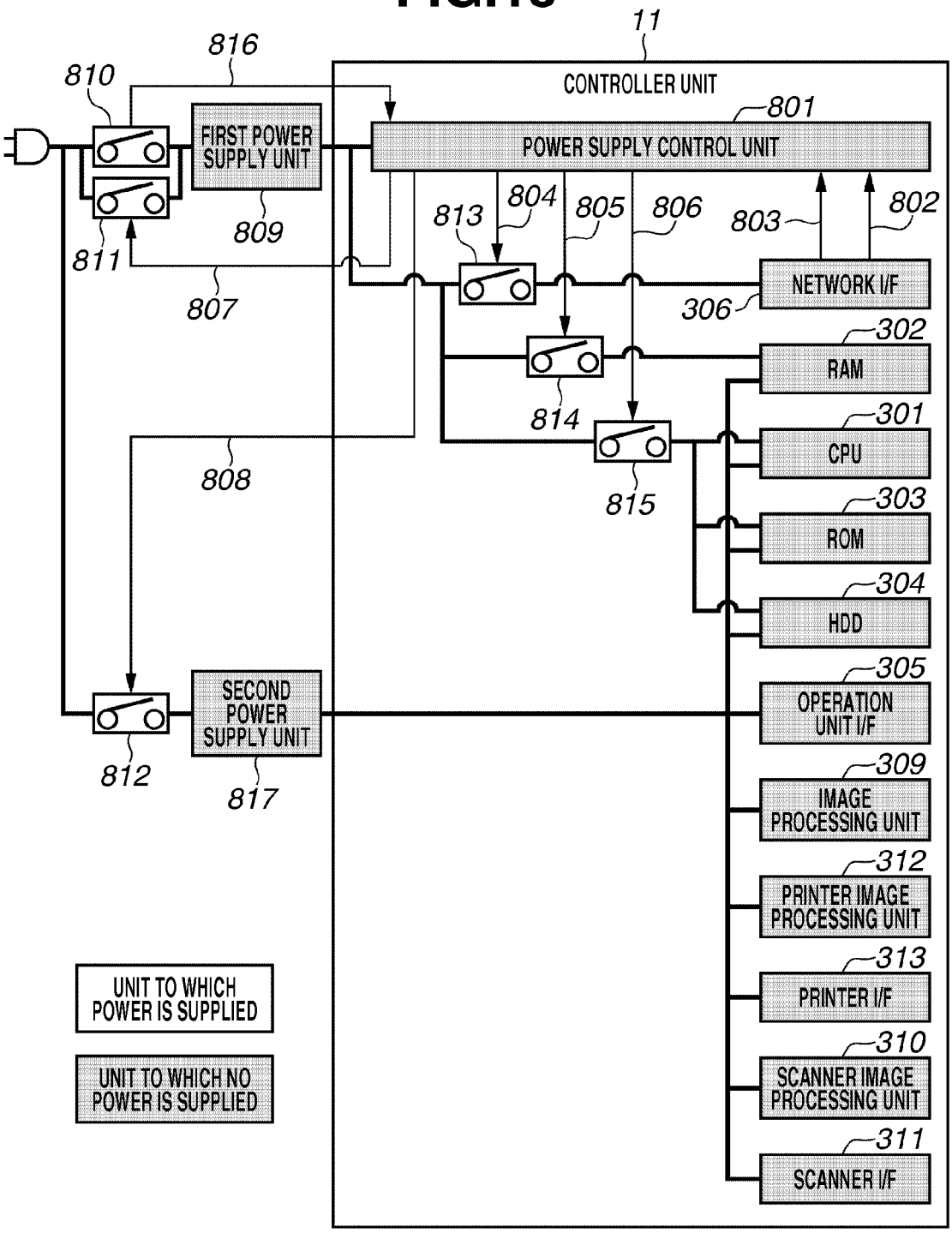
FIG. 13 is a view illustrating an example of the power supply state of the controller 11.

When a packet that is a proxy response unallowable packet and is not a job packet is received at the network I/F 306, the power supply control unit 801 supplies power to the network I/F 306, the RAM 302, the CPU 301, the ROM 303, the HDD 304 and the like. At this time, the power supply control unit 801 controls the first power supply unit 809 to supply the first power (3.3 V) to the RAM 302, the CPU 301, the ROM 303, and the HDD 304, to which either one of the first power supply unit 809 and the second power supply unit 817 can supply power (FIG. 12).

As the foregoing describes, the image forming apparatus according to the exemplary embodiment is configured such that when the image forming apparatus being in the sleep state receives a packet via the network to recover from the sleep state, the devices to which power is to be supplied are changed according to the type of the received packet, and the type of power to be supplied to each device is switched at the same time according to the type of the received packet. Specifically, when the power supply control unit 801 receives a recovery signal (Wake1 signal 802 or Wake2 signal 803), the power supply control unit 801 controls the supply of power such that the first power (3.3 V) or the second power (12 V) is supplied to the devices 301 to 304 depending on the type of the recovery signal.

As the foregoing describes, a received packet is determined at the network I/F 306, and the recovery signal (Wake1 signal 802, Wake2 signal 803) to be output to the power supply control unit 801 is switched according to the determination result. This enables the power supply control unit 801 to supply power only to the devices that need power supply at the time of recovery, and also enables the power supply control unit 801 to switch a power supply unit (first power supply unit (3.3 V), second power supply unit (12 V)) to supply power, whereby the image forming apparatus 10 can be recovered from the sleep state in an optimum recovery state without unnecessary waste to reduce unnecessary power consumption.

The configurations and contents of the various types of data described above are not limited to those described above, and the data may have any configuration or contents corresponding to the purpose of use. The foregoing describes an exemplary embodiment, and additional embodiments, such as a system, an apparatus, a method, a program, a storage medium and the like are also applicable. For example, a system including a plurality of devices or to an apparatus including a single device.

Any combination of the exemplary embodiments is also encompassed within the scope of the present disclosure. Additional embodiments are also applicable to a system including a plurality of devices (e.g., computer, interface apparatus, reader, printer, etc.) or to an apparatus including a single device (multifunction peripheral, printer, facsimile apparatus, etc.).

Another Exemplary Embodiment

Additional exemplary embodiments, include software (program) configured to realize the functions of the foregoing embodiment is supplied to a system or apparatus via a network or various types of storage media, and a computer (or CPU, micro processing unit (MPU), etc.) of the system or apparatus reads and executes the program.

The following describes a second exemplary embodiment.

In the first exemplary embodiment, the first power supply unit 809 and the second power supply unit 817 supply power to the CPU 301, the ROM 303, and the HDD 304. In the second exemplary embodiment, the first power supply unit 809 supplies power to the CPU 301, the ROM 303, and the HDD 304, but neither the second power supply unit 817 nor a third power supply unit 1520 supplies power.

Figure 15:
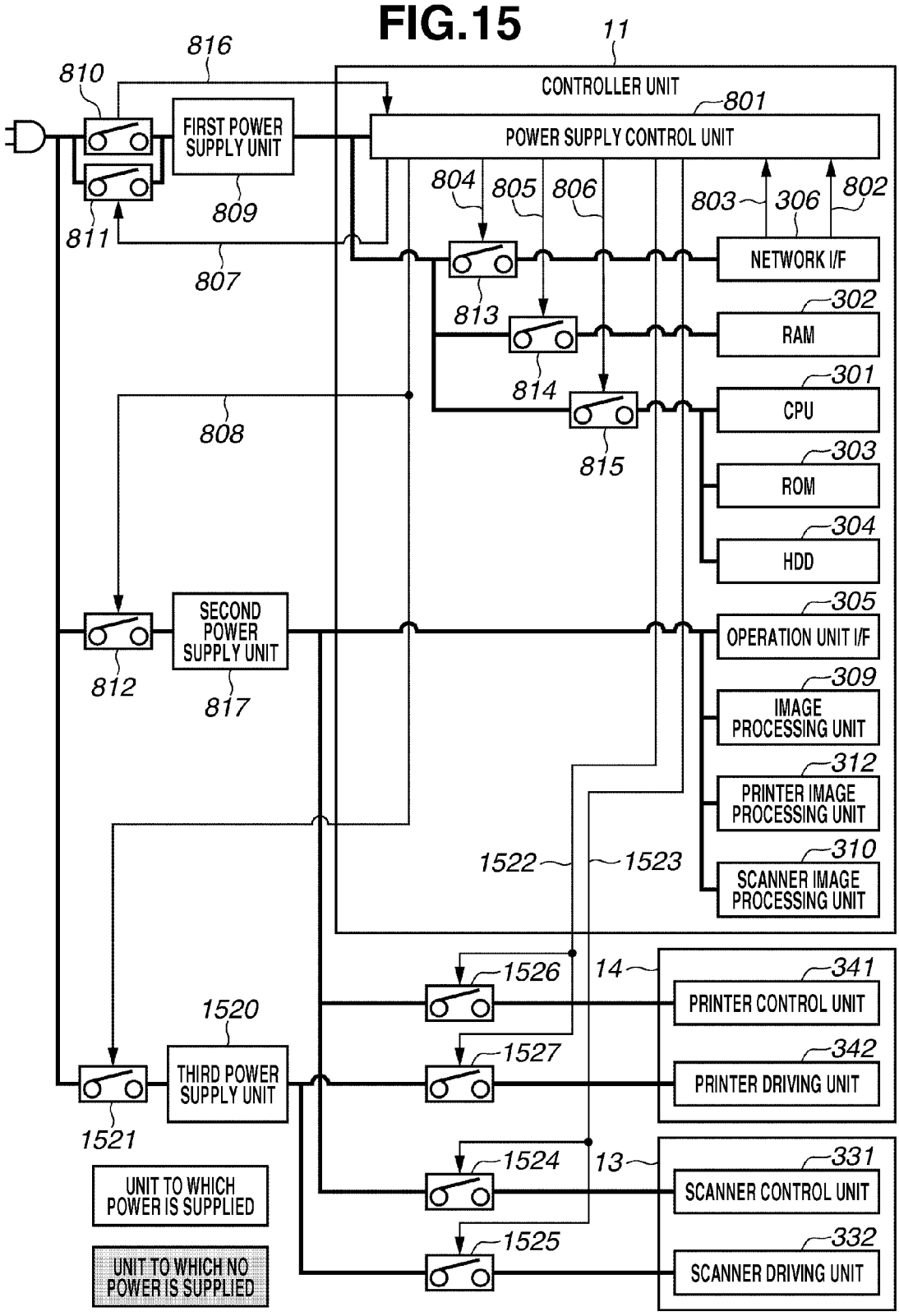
FIG. 15 is a block diagram illustrating an example of a hardware configuration regarding the power supply control of the controller 11.

FIG. 15 is a block diagram illustrating an example of the hardware configuration regarding a power supply control of the controller 11 according to the second exemplary embodiment. The power supply control unit 801 receives commands from the CPU 301, signals from the network I/F 306 (Wake1 signal 802, Wake2 signal 803, etc.) for detection of recovery from the sleep state and the like. Based on the commands, the power supply control unit 801 controls whether to supply of power from the first power supply unit 809 and the second power supply unit 817 to the respective devices. The first power supply unit 809 supplies, for example, 5 V of power. The second power supply unit 817 and the third power supply unit 1520 supply, for example, 12 V of power and 24 V of power. In other words, the voltage of the second power and the voltage of the third power supplied by the second power supply unit 817 and the third power supply unit 1520, respectively, are higher than the voltage of the first power supplied by the first power supply unit 809.

The power supply control unit 801 controls the supply of power by controlling the signals 804 to 808 such that during the standby state in which a job is executable, the first power supply unit 809 supplies power to the CPU 301, the RAM 302, the ROM 303, and the HDD 304. In the standby state, the first power supply unit 809 also supplies power to the network I/F 306 and to the power supply control unit 801. The power supply control unit 801 controls the control signal 808 to control the supply of AC power to the second power supply unit 817 and the third power supply unit 1520. This causes the second power supply unit 817 to supply power to the operation unit I/F 305, the image processing unit 309, the scanner image processing unit 310, and the printer image processing unit 312. The power supply control unit 801 also controls control signals 1522 and 1523 to control the supply of power to the printer unit 14 and the scanner unit 13. The power supply control unit 801 also controls the control signals 804 to 808, 1522, and 1523 such that during the sleep state in which power consumption is limited, the supply of power to the devices 301 to 304, 305, 309, 310, 312, 341, 342, 331, and 332 is stopped while the first power supply unit 809 supplies power to the network I/F 306 and the power supply control unit 801. In other words, when the image forming apparatus 10 is shifted from the standby state to the sleep state, the power supply control unit 801 controls the supply of power to block the power supplied to the devices 301 to 304, 305, 309, 310, 312, 341, 342, 331, and 332.

The Wake1 signal 802 is a signal transmitted from the network I/F 306 to the power supply control unit 801 to notify the power supply control unit 801 of reception of a job packet when the network I/F 306 receives the job packet via the network 60 during the sleep state. When the power supply control unit 801 detects the Wake1 signal 802, the power supply control unit 801 controls the control signals 804 to 808 and 1522 to select a power supply state with respect to each device (details will be described below). The Wake2 signal (second recovery signal) 803 is a signal transmitted from the network I/F 306 to the power supply control unit 801 to notify the power supply control unit 801 of reception of a packet (e.g., inquiry of the state of the image forming apparatus 10, etc.) that is not a proxy response allowable packet (e.g., address resolution protocol (ARP) packet, web services on device (WSD) search packet, etc.) when the network I/F 306 receives the packet via the network 60 during the sleep state. When the power supply control unit 801 detects the Wake2 signal 803, the power supply control unit 801 controls the control signals 804 to 808 and 1522 to select a state of power supply with respect to each device (details will be described below).

The control signals 804 to 808, 1522, and 1523 are signals for controlling whether to supply power to the respective devices.

The switches 811 to 815, 1521, and 1524 to 1527 are controlled by the control signals 804 to 808, 1522, and 1523. The power supply control unit 801 controls the switches 811 to 815, 1521, and 1524 to 1527 through the control signals 804 to 808, 1522, and 1523 to enable changing a power supply state with respect to each device. The switches 811 to 815, 1521, and 1524 to 1527 can be realized using an FET, a relay switch or the like.

The control signal 804 and the switch 813 control the supply of power to the network I/F 306. while power is supplied to the network I/F 306 when the image forming apparatus 10 is in the standby state or in the sleep state, the supply of power to the network I/F 306 is stopped when the image forming apparatus 10 is in an off state. In other words, the switch 813 switches between supply and stop of power from the first power supply unit 809 to the network I/F 306.

The control signal 805 and the switch 814 control the supply of power from the first power supply unit 809 to the RAM 302. The switch 814 control the supply of power such that power is supplied from the first power supply unit 809 to the RAM 302 when the image forming apparatus 10 is in the standby state or in the sleep state, whereas the supply of power from the first power supply unit 809 to the RAM 302 is stopped when the image forming apparatus 10 is in the off state. In other words, the switch 814 switches between supply and stop of power from the first power supply unit 809 to the RAM 302.

The control signal 806 and the switch 815 control the supply of power from the first power supply unit 809 to the CPU 301, the ROM 303, and the HDD 304. Specifically, the switch 815 (second switching unit) switches between supply and stop of power from the first power supply unit 809 to the CPU 301, the ROM 303, and the HDD 304. The control signal 807 and the switch 811 control the supply of AC power to the first power supply unit 809. The power supply control unit 801 turns on the control signal 807 and the switch 811 when a switch 810 to be described later is turned on. Hence, even when a user turns off the switch 810, power can be supplied to the controller 11. At this time, the power supply control unit 801 detects that the switch 810 has been turned off through a signal 816 for obtaining information about whether the switch 810 is on/off. The power supply control unit 801 notifies the CPU 301 that the switch 810 has been turned off, so that the CPU 301 can first execute normal shutdown processing and then shift the power supply to each device to the off state.

The switch 810 is operated by a user to turn on/off the image forming apparatus 10. When a user turns on the switch 810, the supply of AC power to the first power supply unit 809 is started.

The control signal 808 and the switch 812 control the supply of AC power to the second power supply unit 817. The control signal 808 and the switch 812 also control the supply of power from the second power supply unit 817 to each device. For example, as to the supply of power to the image processing unit 309, when the image forming apparatus 10 is in the sleep state, the switch 812 is turned off to stop the supply of power from the second power supply unit 817 to the image processing unit 309. On the other hand, when the image forming apparatus 10 is in the standby state, the switch 812 is turned on to supply power from the second power supply unit 817 to the image processing unit 309. In other words, the power supply control unit 801 controls the switch 812 to turn on or off the switch 812, so that the supply of power from the second power supply unit 817 is started or stopped.

The control signal 808 and the switch 1521 control the supply of AC power to the third power supply unit 1520.

The first power supply unit 809 converts the AC power into DC power to supply the first power to the power supply control unit 801 and the like. The first power supplied from the first power supply unit 809 is provided to supply power to the power supply control unit 801 and the like even if the image forming apparatus 10 is shifted to the sleep state. The first power is supplied not only to the power supply control unit 801 but also to the network I/F 306 configured to detect an incoming packet from the network 60 to recover the image forming apparatus 10 from the sleep state.

The second power supply unit 817 converts the AC power into DC power to supply the second power to each device. The supply of the second power, which is supplied from the second power supply unit 817, is stopped when the image forming apparatus 10 is in the sleep state. The second power supply unit 817 is provided to reduce power consumption during the sleep state. The second power supply unit 817 is configured to supply power to devices that do not need the supply of power when the image forming apparatus 10 is in the sleep state.

The third power supply unit 1520 converts the AC power into DC power to supply the third power to each device. The supply of the third power, which is supplied from the third power supply unit 1520 to a printer driving unit 342 and a scanner driving unit 332, is stopped when the image forming apparatus 10 is in the sleep state. The third power supply unit 1520 is provided to reduce power consumption during the sleep state. The third power supply unit 1520 is configured to supply power to devices that do not need the supply of power when the image forming apparatus 10 is in the sleep state.

The control signal 1522 and switches 1526 and 1527 control the supply of the second power and the third power to the printer control unit 341 and the printer driving unit 342. In other words, the control signal 1522 and the switches 1526 and 1527 are provided to control the supply of power to the printer unit 14. For example, as to the supply of power to the printer unit 14, when the image forming apparatus 10 is in the sleep state, the switches 1526 and 1527 are turned off to stop the supply of power to the printer unit 14. On the other hand, when the image forming apparatus 10 executes printing, the switches 1526 and 1527 are turned on to allow the supply of power from the second power supply unit 817 and the third power supply unit 1520 to the printer unit 14. In other words, the power supply control unit 801 controls the switches 1526 and 1527 to turn on or off the switches 1526 and 1527, so that the supply of power from the second power supply unit 817 and the third power supply unit 1520 is switched between supply and stop.

The control signal 1523 and the switches 1524 and 1525 control the supply of the second power and the third power to the scanner control unit 331 and the scanner driving unit 332. In other words, the control signal 1523 and the switches 1524 and 1525 are provided to control the supply of power to the scanner unit 13. For example, as to the supply of power to the scanner unit 13, when the image forming apparatus 10 is in the sleep state, the switches 1524 and 1525 are turned off to stop the supply of power to the scanner unit 13. On the other hand, when the image forming apparatus 10 executes scanning, the switches 1524 and 1525 are turned on to start the supply of power from the second power supply unit 817 and the third power supply unit 1520 to the scanner unit 13. In other words, the power supply control unit 801 controls the switches 1524 and 1525 to turn on or off the switches 1524 and 1525, so that the supply of power from the second power supply unit 817 and the third power supply unit 1520 is switched between supply and stop.

The scanner control unit 331 receives scanner settings from a user via communication with the CPU 301 to control the scanner driving unit 332 based on the received scanner settings. The CPU 301 may replace the scanner control unit 331 to control the scanner driving unit 332. The scanner driving unit 332 is a physically operating unit such as a motor of an automatic document feeder (ADF) for conveying sheets (not illustrated). The scanner driving unit 332 operates as controlled by the scanner control unit 331.

The printer control unit 341 receives printer settings from a user via communication with the CPU 301 to control the printer driving unit 342 based on the received printer settings. The CPU 301 may replace the printer control unit 341 to control the printer driving unit 342. The printer driving unit 342 is a physically operating unit such as a fixing unit (not illustrated) and a sheet conveying motor (not illustrated). The printer driving unit 342 operates as controlled by the printer control unit 341.

Figure 14:
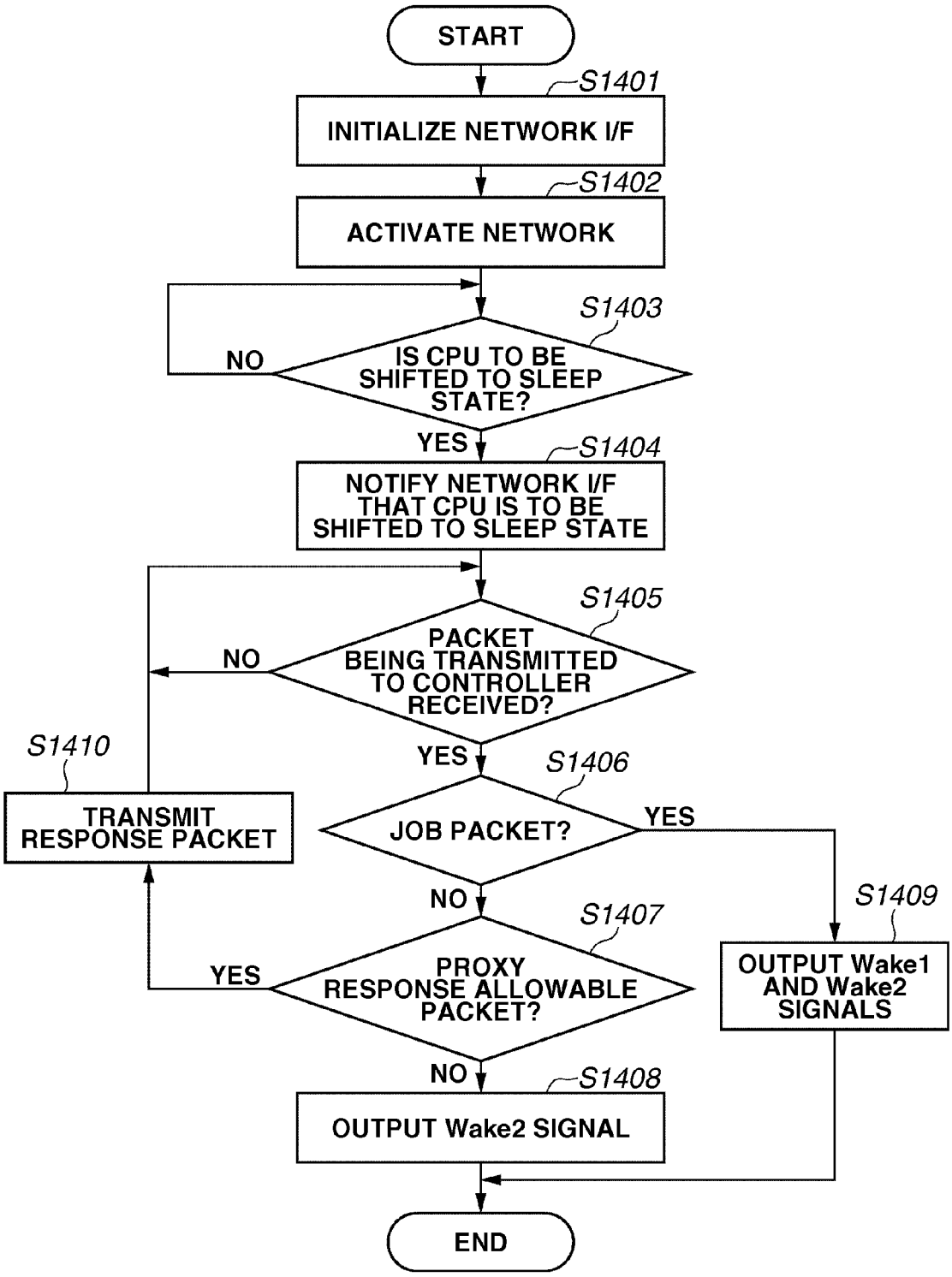
FIG. 14 is a flow chart illustrating an example of processing to be executed by the controller 11.

FIG. 14 is a flow chart illustrating an example of processing to be executed by the controller 11 according to the second exemplary embodiment. Processing from step S1401 to step S1408 and step S1410 is the same as the processing from step S501 to step S508 and step S510 in FIG. 5. Thus, description thereof is omitted in this section. In step S1409, the WOL detection unit 401 outputs the Wake1 signal 802 and the Wake2 signal 803 (FIG. 8) to the power supply control unit 801. Then, the processing illustrated in the flow chart is finished. In the first exemplary embodiment, the Wake1 signal 802 is output to the power supply control unit 801, so that the power supply control unit 801 is shifted to the state in which the power supply control unit 801 is ready to execute printing, as illustrated in FIG. 9. In the second exemplary embodiment, on the other hand, both the Wake1 signal 802 and the Wake2 signal 803 are output to determine that the power supply control unit 801 is in the state in which power supply control unit 801 is ready to execute printing.

Figure 16:
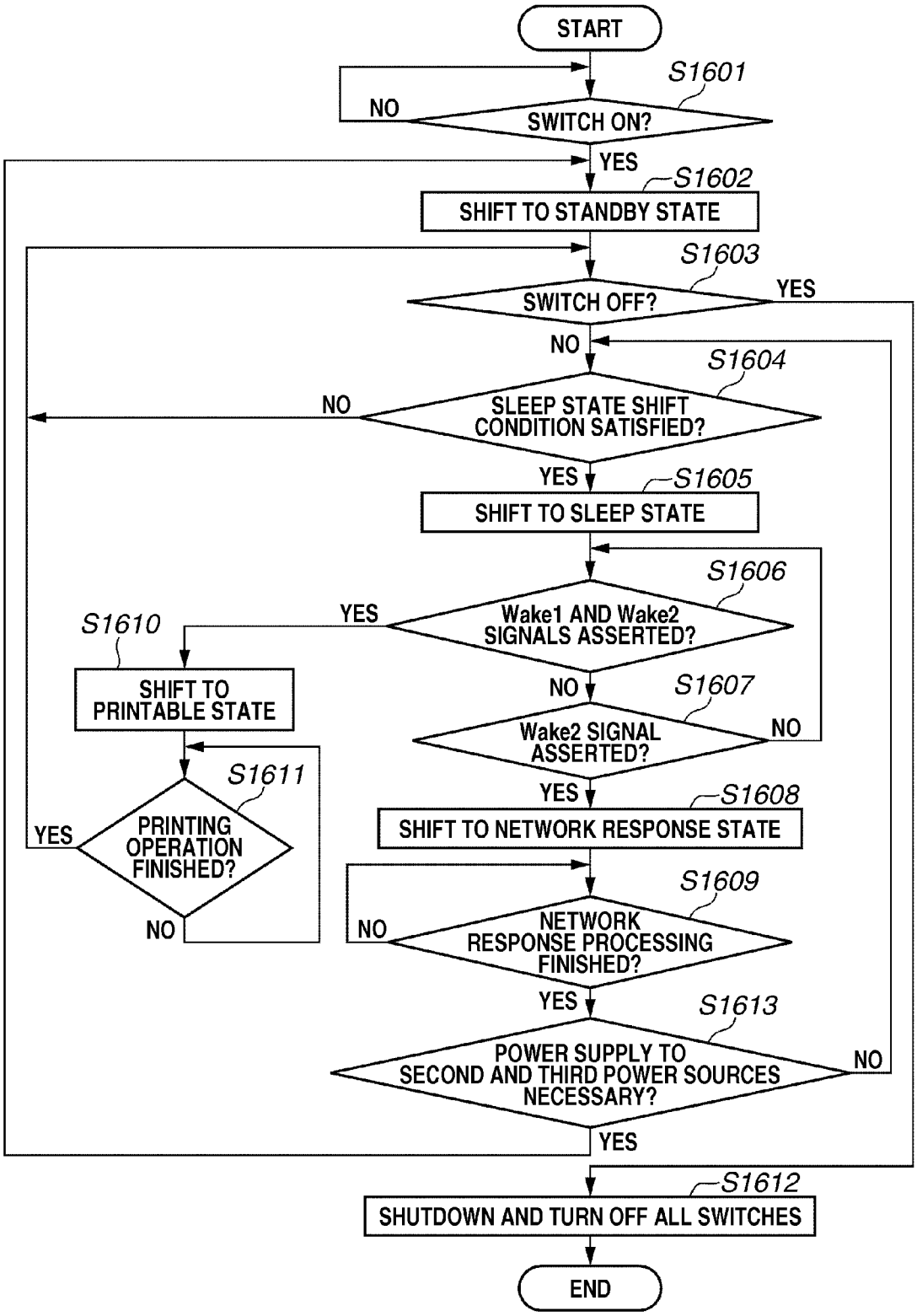
FIG. 16 is a flow chart illustrating an example of power supply control processing to be executed by the power supply control unit 801.
Figure 17:
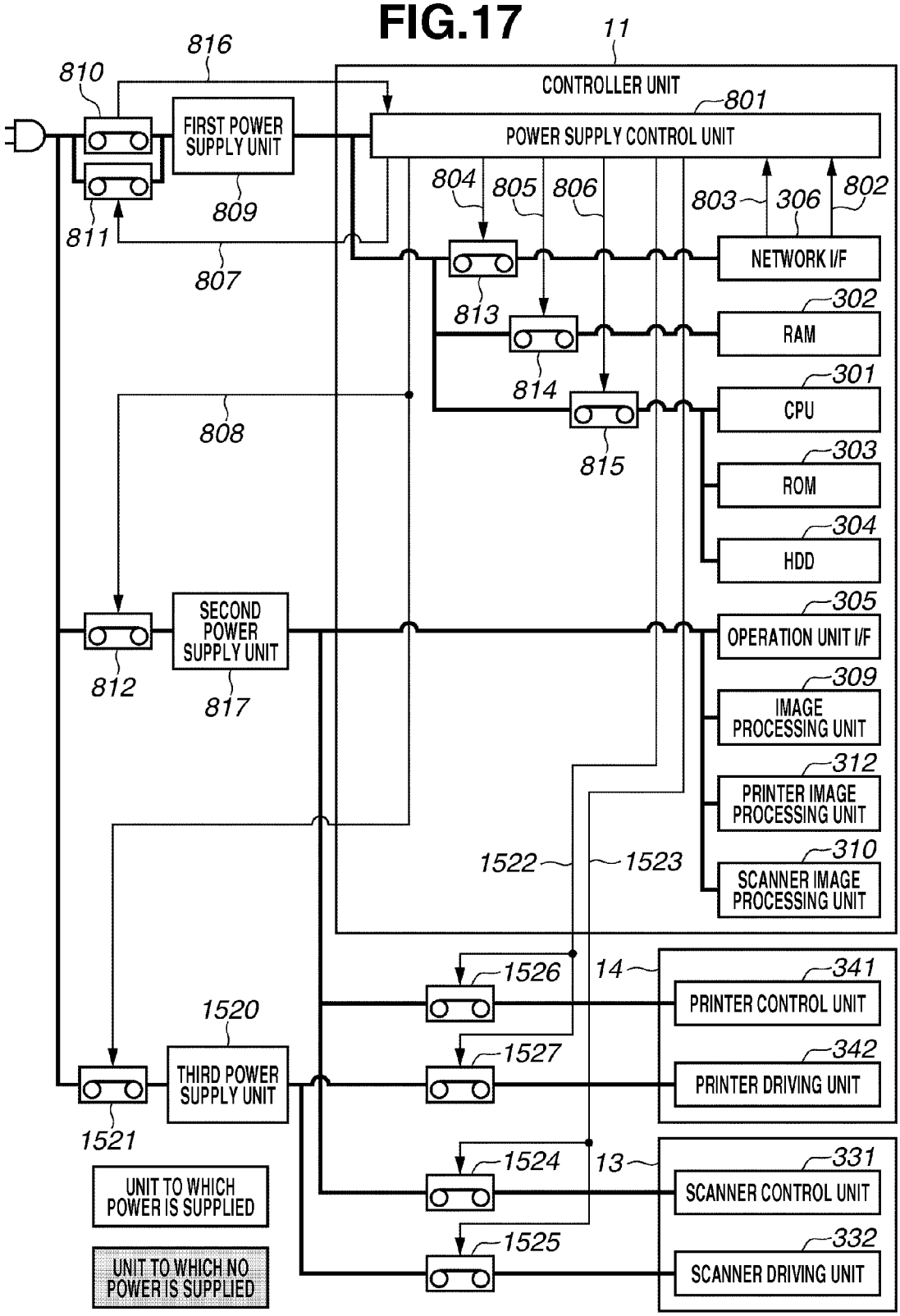
FIG. 17 is a view illustrating an example of the power supply state of the controller 11.
Figure 18:
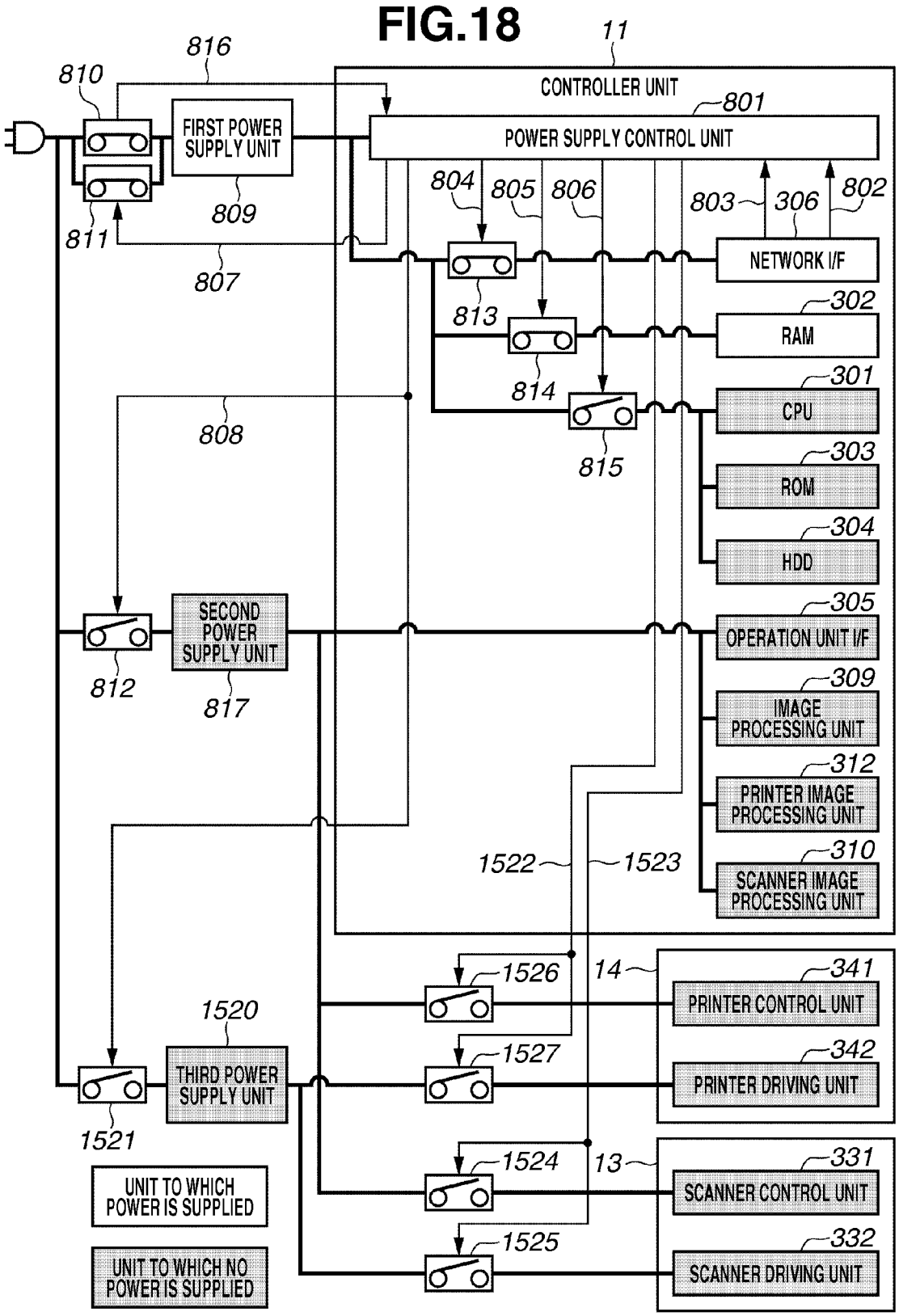
FIG. 18 is a view illustrating an example of the power supply state of the controller 11.

The following describes how the power supply control unit 801 according to the second exemplary embodiment controls the supply of power to each device, with reference to the flow chart illustrated in FIG. 16. Specifically, the following describes processing including shifting the image forming apparatus 10 from a power-on state to the sleep state, receiving a return packet transmitted via the network 60 by the network I/F 306, and then recovering the image forming apparatus 10 from the sleep state. FIG. 16 is a flow chart illustrating an example of power supply control processing executed by the power supply control unit 801. FIGS. 17 to 21 are views illustrating examples of the power supply states of the controller 11, the printer unit 14, and the scanner unit 13.

The CPU 301 realizes the processing illustrated in FIG. 16 that is to be executed by the CPU 301 reading and executing a program stored in the ROM 303 or the HDD 304. The power supply control unit 801 may be, for example, a one-chip microcomputer including a single (IC) chip on which a microprocessor, a RAM, a ROM, various types of input and output devices and the like are mounted, a PLD, an ASIC, a logic circuit, or any other configuration. The power supply control unit 801 may have any configuration that can realize the processing illustrated in FIG. 16 that is to be executed by the power supply control unit 801. When a user turns on the switch 810 (YES in step S1601), in step S1602, power is supplied to the power supply control unit 801 to shift the image forming apparatus 10 to the standby state. Specifically, when the power is supplied to the power supply control unit 801, the power supply control unit 801 controls the control signals 804 to 808, 1522, and 1523 to turn on the switches 811 to 815, 1521, and 1524 to 1527. As a result, power is supplied to every one of the devices illustrated in FIG. 15. All of the first power supply unit 809, the second power supply unit 817, and the third power supply unit 1520 are supplying power to the respective devices (refer to FIG. 17), and the image forming apparatus 10 is shifted to the standby state.

Up to the point when the switch 810 is turned on, no power is supplied to the power supply control unit 801 and, thus, the control signals 804 to 808, 1522, and 1523 are controlled to keep the switches 811 to 815, 1521, and 1524 to 1527 in the off state. In step S1603, the CPU 301 determines whether the power has been turned off. Specifically, when the power supply control unit 801 detects that a user has turned off the switch 810 through the signal 816 (YES in step S1603), the power supply control unit 801 notifies the CPU 301 that the user has turned off the switch 810. When the CPU 301 receives this notification, the CPU 301 determines that the power has been turned off. Unless the CPU 301 receives the notification (NO in step S1603), the CPU 301 determines that the power has not been turned off. When the CPU 301 determines that the power has been turned off (YES in step S1603), the processing is moved to step S1612.

In step S1612, the CPU 301 executes shutdown processing and notifies the power supply control unit 801 of the execution of the shutdown processing. When the power supply control unit 801 receives the notification of the execution of the shutdown processing from the CPU 301, the power supply control unit 801 controls the control signals 804 to 808, 1522, and 1523 to turn off the switches 811 to 815, 1521, and 1524 to 1527, so that the supply of power to every one of the devices is stopped (refer to FIG. 20).

On the other hand, in step S1603, if the CPU 301 determines that the power has not been turned off (NO in step S1603), the CPU 301 moves the processing to step S1604. In step S1604, the CPU 301 determines whether the image forming apparatus 10 is to be shifted to the sleep state. If the CPU 301 determines that a sleep state shift condition is not satisfied, the CPU 301 determines that the image forming apparatus 10 is not to be shifted to the sleep state (NO in step S1604). Then, the processing is moved back to step S1603. Examples of a sleep state shift condition include shifting to the sleep state by a timer and the like. For example, a case in which neither printing nor scanning has been instructed for a predetermined period or longer. On the other hand, if the CPU 301 determines that the sleep state shift condition is satisfied, the CPU 301 determines that the image forming apparatus 10 is to be shifted to the sleep state (Yes in step S1604). Then, the processing is moved to step S1605.

In step S1605, the CPU 301 executes processing to shift the image forming apparatus 10 to the sleep state and sends a notification to the power supply control unit 801 to notify that the image forming apparatus 10 is to be shifted to the sleep state. When the power supply control unit 801 receives the notification from the CPU 301, the power supply control unit 801 controls the control signals 804 to 808, 1522, and 1523 to turn on the switches 811, 813, and 814 and turn off the switches 812, 815, 1521, and 1524 to 1527. In other words, when the image forming apparatus 10 is in the sleep state, power is supplied only to the power supply control unit 801, the network I/F 306, and the RAM 302 among the devices, all of the power supply control unit 801, the network I/F 306, and the RAM 302 are receiving the power (5 V) from the first power supply unit 809 (first power state) (refer to FIG. 18).

When the image forming apparatus 10 is shifted to the sleep state, in step S1606, the power supply control unit 801 executes monitoring to determine whether the Wake1 signal 802 and the Wake2 signal 803, which are output from the network I/F 306, are asserted.

When the power supply control unit 801 determines that assertion of the Wake1 signal 802 and the Wake2 signal 803 is detected (YES in step S1606), the processing is moved to step S1610. In step S1610, the power supply control unit 801 controls the control signal 804 to 806, 808, 1522, and 1523 to turn on the switches 812 to 815, 1521, 1526, and 1527 and turn off the switches 1524 and 1525. In other words, the power supply control unit 801 controls the image forming apparatus 10 to shift the image forming apparatus 10 to a power supply state in which the image forming apparatus 10 can only execute printing (refer to FIG. 21). As a result, power is supplied to the CPU 301, so that the CPU 301 is recovered to be in a state in which the CPU 301 is ready to execute printing.

In step S1611, the CPU 301 executes monitoring to determine whether the printing operation executed step S1610 is finished. The CPU 301 repeats the processing of step S1611 until the printing operation is finished (while NO in step S1610). When the CPU 301 determines that the printing operation is finished (YES in step S1611), the CPU 301 moves the processing to step S1603. On the other hand, in step S1606, if the power supply control unit 801 determines that assertion of the Wake1 signal 802 and the Wake2 signal 803 is not detected (NO in step S1606), the power supply control unit 801 moves the processing to step S1607.

In step S1607, the power supply control unit 801 determine whether the Wake2 signal 803, which is output from the network I/F 306, is asserted.

If the power supply control unit 801 determines that assertion of the Wake2 signal 803 is not detected (NO in step S1607), the processing is moved back to step S1606.

On the other hand, if the power supply control unit 801 determines that assertion of the Wake2 signal 803 is detected (YES in step S1607), the processing is moved to step S1608.

In step S1608, the power supply control unit 801 perform control to shift the image forming apparatus 10 to a network response state. Specifically, the power supply control unit 801 controls the control signals 804 to 808, 1522, and 1523 to turn on the switches 811, 813, 814, and 815 and turn off the switches 812 and 1524 to 1527. In other words, when the image forming apparatus 10 is in the network response state, power is supplied only to the power supply control unit 801, the network I/F 306, the RAM 302, the CPU 301, the ROM 303, and the HDD 304 among the devices, and all of the power supply control unit 801, the network I/F 306, the RAM 302, the CPU 301, the ROM 303, and the HDD 304 are receiving power (5 V) from the first power supply unit 809 (refer to FIG. 19). As a result, power is supplied to the CPU 301 so that the CPU 301 is recovered to be in a state in which the CPU 301 is ready to execute responding operation. The CPU 301 receives from the network I/F 306 a packet that is a proxy response unallowable packet and not a job packet (e.g., SNMP GetRequest packet, etc.) and executes responding operation corresponding to the packet. Although the power is supplied to the HDD 304 in the foregoing case, if the CPU 301 can respond to a network packet even if no power is supplied to the HDD 304, it is not necessary to supply power to the HDD 304.

In step S1609, the CPU 301 determines whether the network response processing is finished.

Until the network response processing is finished (while NO in step S1609), the CPU 301 repeats the processing of step S1609.

If the CPU 301 determines that the network response processing is finished (YES in step S1609), the CPU 301 moves the processing to step S1613.

In step S1613, the CPU 301 determines whether it is necessary to supply power to the second power supply unit 817 and the third power supply unit 1520. If it is necessary to supply power to the second power supply unit 817 and the third power supply unit 1520 (YES in step S1613), the processing is moved to step S1602 to shift the image forming apparatus 10 to the standby state. For example, if the CPU 301 receives a job packet from the network I/F 306 while executing the processing of step S1609, it is necessary to supply power to the printer unit 14. On the other hand, if it is not necessary to supply power to the second power supply unit 817 and the third power supply unit 1520 (NO in step S1613), the processing proceeds to step S1604.

As the foregoing describes, a received packet is determined at the network I/F 306, and the network I/F 306 switches the Wake signal to be output to the power supply control unit 801 according to the determination result. This enables the power supply control unit 801 to supply power only to the devices that need the supply of power at the time of recovery, and also enables the power supply control unit 801 to switch a power supply unit to supply power, whereby an optimum recovery state can be created to reduce unnecessary power consumption.

Figure 19:
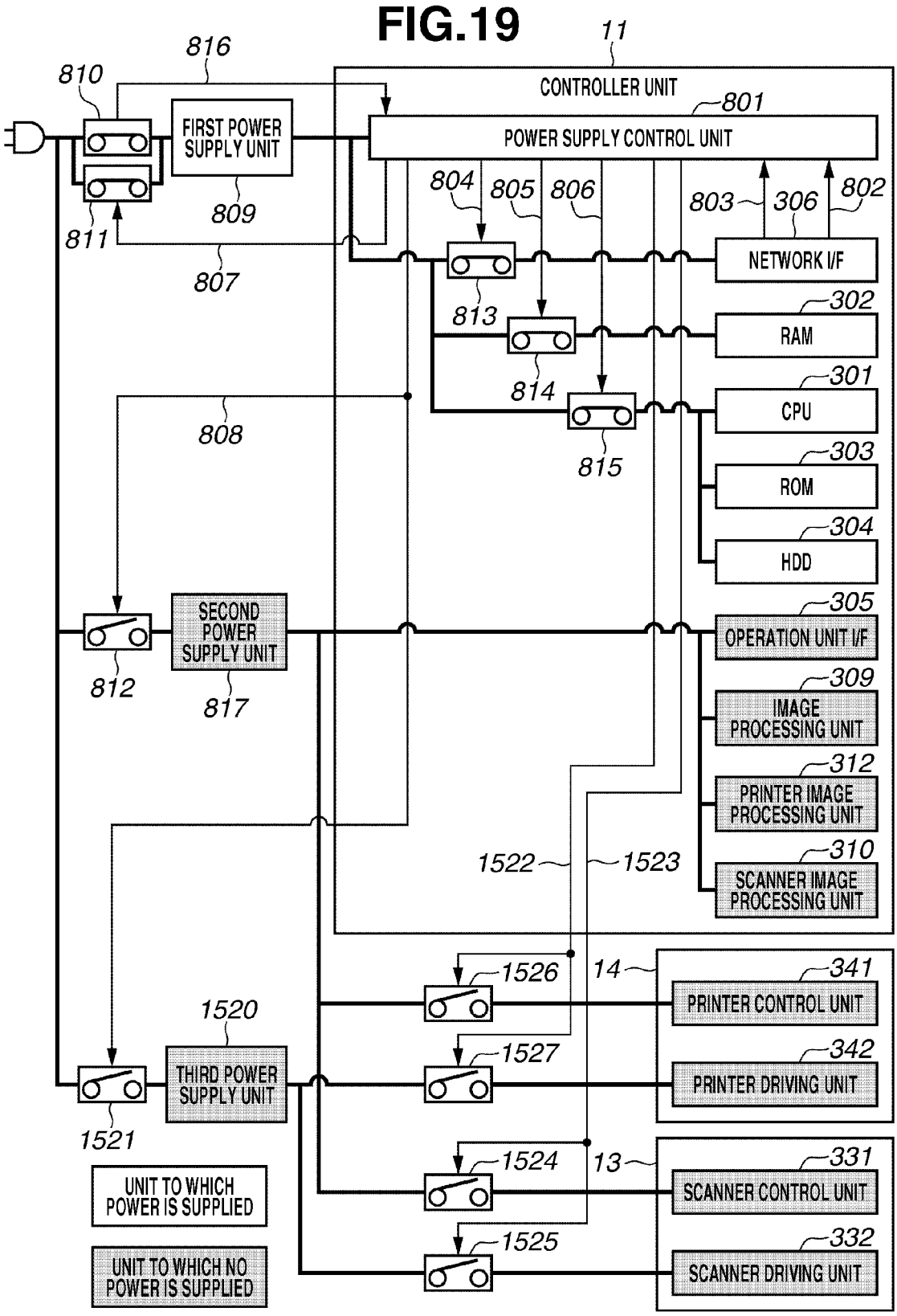
FIG. 19 is a view illustrating an example of the power supply state of the controller 11.
Figure 20:
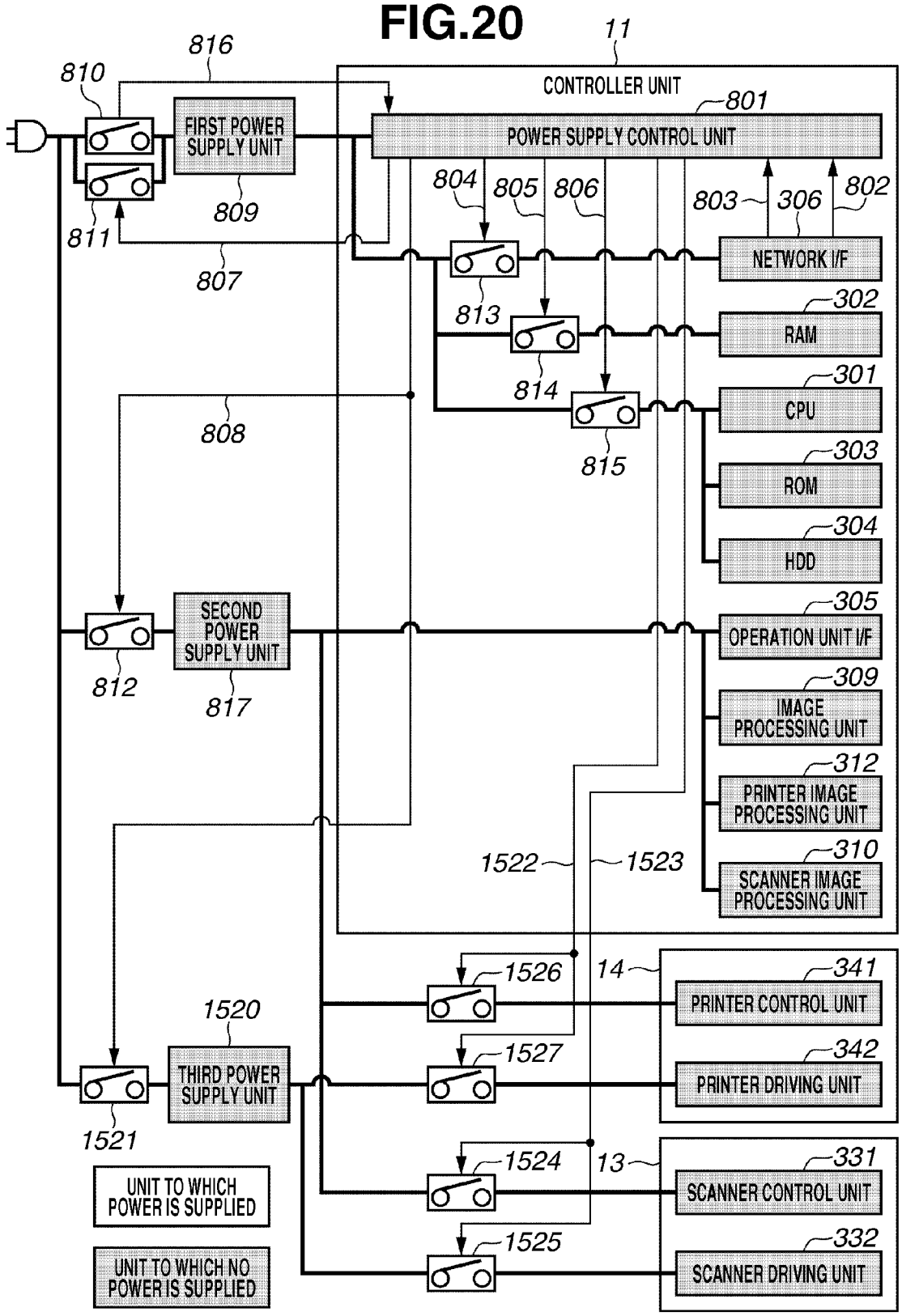
FIG. 20 is a view illustrating an example of the power supply state of the controller 11.
Figure 21:
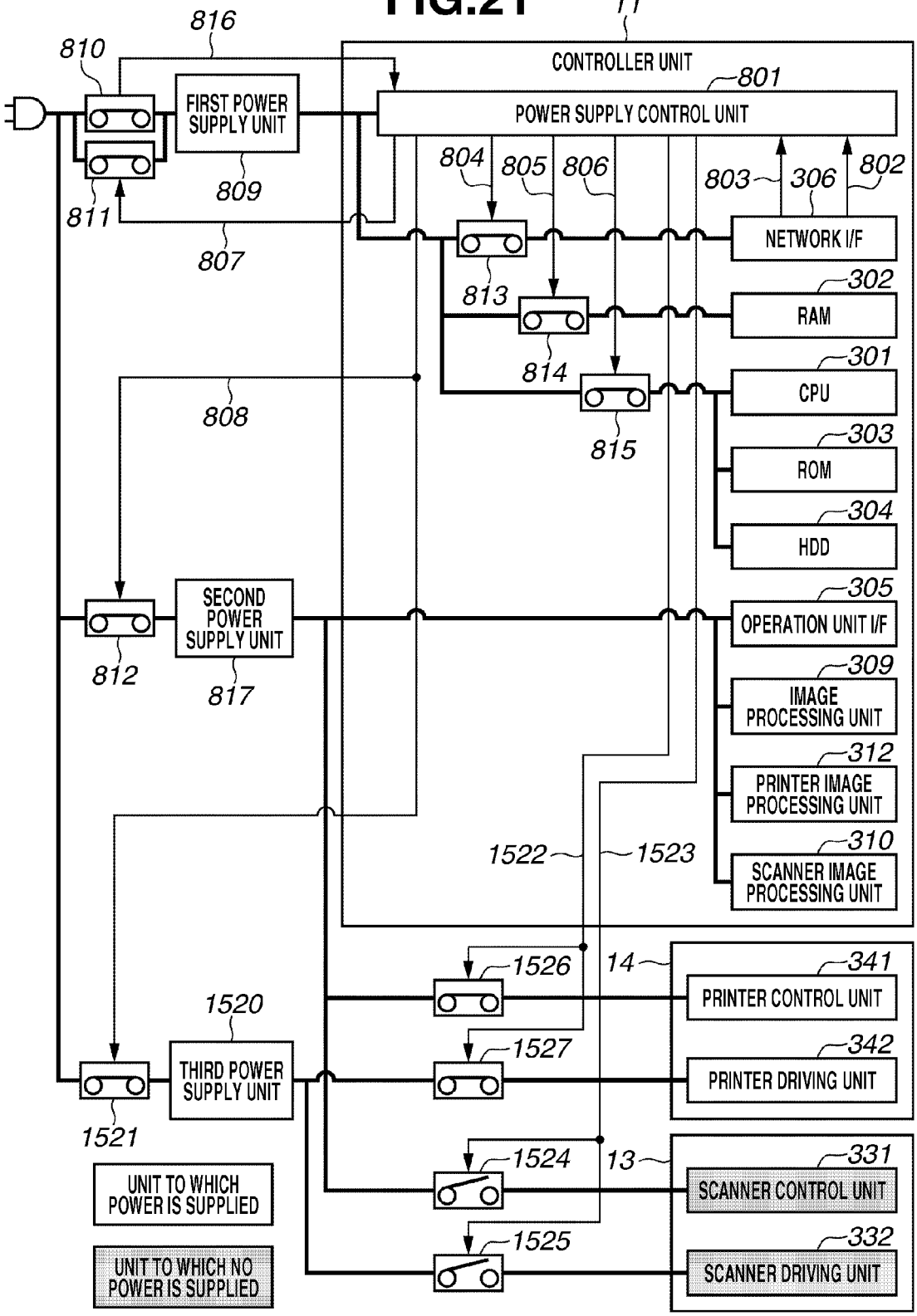
FIG. 21 is a view illustrating an example of the power supply state of the controller 11.

For example, when a job packet is received at the network I/F 306, the power supply control unit 801 supplies power to the controller 11 and the printer unit 14. When a packet that is a proxy response unallowable packet and is not a job packet is received at the network I/F 306, the power supply control unit 801 supplies power to the network I/F 306, the RAM 302, the CPU 301, the ROM 303, and the HDD 304. At this time, the power supply control unit 801 controls the first power supply unit 809 to supply the first power (5 V) to the RAM 302, the CPU 301, the ROM 303, and the HDD 304, to which the first power supply unit 809 can supply power (FIG. 19). As the foregoing describes, a received packet is determined at the network I/F 306, and the recovery signal (Wake1 signal 802, Wake2 signal 803) to be output to the power supply control unit 801 is switched according to the determination result. This enables the power supply control unit 801 to supply power only to the devices that need power supply at the time of recovery, whereby unnecessary power consumption can be reduced.

The configurations and contents of the various types of data described above are not limited to those described above, and the data may have any configuration or contents corresponding to the purpose of use. The foregoing describes an exemplary embodiment, and additional embodiments such as a system, an apparatus, a method, a program, a storage medium and the like are also applicable. For example, a system including a plurality of devices or to an apparatus including a single device.

Any combination of the exemplary embodiments is also encompassed within the scope of the present disclosure. Additional embodiments are also applicable to a system including a plurality of devices (e.g., computer, interface apparatus, reader, printer, etc.) or to an apparatus including a single device (multifunction peripheral, printer, facsimile apparatus, etc.).

The present disclosure is not limited to the above exemplary embodiments, and various modifications are possible based on the spirit of the present disclosure (including organic combinations of the exemplary embodiments).

Aspects of the present invention enable recovery from the power-saving state in an optimum power state without unnecessary waste so that unnecessary power consumption can be reduced.

Other Embodiments

Embodiments of the present invention can also be realized by a computer of a system or apparatus that reads out and executes computer executable instructions recorded on a storage medium (e.g., computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that these embodiments are not seen to be limiting. The scope of the following claims is to be accorded the broadest interpretation so as to encompass all such modifications and equivalent structures and functions.

This application claims the benefit of Japanese Patent Application No. 2012-199610 filed Sep. 11, 2012, which is hereby incorporated by reference herein in its entirety.

What is claimed is:

1. An image forming apparatus configured to operate in a plurality of power states, the image forming apparatus comprising:

a receiving unit configured to receive data;

a control unit configured to process data received by the receiving unit;

an image forming unit configured to form an image on a sheet using the data processed by the control unit;

a first power supply unit configured to supply power to the control unit and the receiving unit;

a second power supply unit configured to supply power to the image forming unit; and a power control unit configured, in a first power state in which the first power supply unit supplies power to the receiving unit but does not supply power to the control unit, (A) to perform control such that in a case where a received packet received by the receiving unit is a first type packet, the first power supply unit supplies power to the control unit but the second power supply unit does not supply power to the image forming unit, and (B) to perform control such that in a case where a received packet received by the receiving unit is a second type packet, the first power supply unit supplies power to the control unit and the second power supply unit supplies power to the image forming unit, wherein the power control unit is configured to perform control such that the first power supply unit stops power to the control unit in response to the control unit processing the first type packet in a case where the received packet is the first type packet and the power control unit is configured to perform control such that the first power supply unit stops power to the control unit after a predetermined time period elapsed in a case where the received packet is the second type packet.

2. The image forming apparatus according to claim 1, wherein in the first power state, in a case where a received packet received by the receiving unit is a third type packet, the first power supply unit does not supply power to the control unit.

3. The image forming apparatus according to claim 2, wherein in a case where the receiving unit receives the third type packet, the receiving unit generates and transmits a response packet corresponding to the third type packet.

4. The image forming apparatus according to claim 1, further comprising a storage unit to which power is supplied from the first power supply unit, wherein in the first power state in which the first power supply unit supplies power to the receiving unit but does not supply power to the control unit, in a case where a received packet received by the receiving unit is the first type packet, the first power supply unit supplies power to the control unit and the storage unit but the second power supply unit does not supply power to the image forming unit.

5. The image forming apparatus according to claim 4, wherein the storage unit is a hard disk drive.

6. The image forming apparatus according to claim 1, wherein the receiving unit compares the received packet with a registered packet pattern to determine a type of the received packet.

7. The image forming apparatus according to claim 6, wherein the receiving unit includes a storage unit configured to store the packet pattern.

8. The image forming apparatus according to claim 1, wherein if a destination port number of the received packet matches a predetermined number, the receiving unit determines that the received packet is the second type packet.

9. The image forming apparatus according to claim 1, wherein the control unit is a central processing unit (CPU).

10. The image forming apparatus according to claim 1, wherein in a case where the received packet received by the receiving unit is the first type packet, the control unit generates a response packet corresponding to the first type packet.

11. The image forming apparatus according to claim 1, wherein the second type packet causes the image forming unit to form an image.

12. A method of controlling an image forming apparatus configured to operate in a plurality of power states including a receiving unit configured to receive data, a control unit configured to process data received by the receiving unit, an image forming unit configured to form an image on a sheet using the data processed by the control unit, a first power supply unit configured to supply power to the control unit and the receiving unit and a second power supply unit configured to supply power to the image forming unit, the method comprising:

supplying power from the first power supply unit to the control unit but not supplying power from the second power supply to the image forming unit in a case where a received packet received by the receiving unit is a first type packet in a first power state in which the first power supply unit supplies power to the receiving unit but does not supply power to the control unit; and supplying power from the first power supply unit to the control unit and supplying power from the second power supply unit to the image forming unit in a case where the received packet received by the receiving unit is a second type packet in a first power state in which the first power supply unit supplies power to the receiving unit but does not supply power to the control unit, wherein the first power supply unit stops power to the control unit in response to the control unit processing the first type packet in a case where the received packet is the first type packet, and controlling the first power supply unit stops power to the control unit after a predetermined time period elapses in a case where the received packet is the second type packet.

* * * * *